US011193082B2

(12) United States Patent
Tagawa et al.

(10) Patent No.: US 11,193,082 B2
(45) Date of Patent: Dec. 7, 2021

(54) WAX ISOMERIZED OIL

(71) Applicant: ENEOS Corporation, Tokyo (JP)

(72) Inventors: Kazuo Tagawa, Tokyo (JP); Fuyuki Aida, Tokyo (JP); Koshi Takahama, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 16/982,653

(22) PCT Filed: Mar. 27, 2019

(86) PCT No.: PCT/JP2019/013333
§ 371 (c)(1),
(2) Date: Sep. 21, 2020

(87) PCT Pub. No.: WO2019/189448
PCT Pub. Date: Oct. 3, 2019

(65) Prior Publication Data

US 2021/0024849 A1 Jan. 28, 2021

(30) Foreign Application Priority Data

Mar. 27, 2018 (JP) ..... JP2018-059577

(51) Int. Cl.
*C10M 143/02* (2006.01)
*C10G 45/64* (2006.01)
*C10M 169/04* (2006.01)

(52) U.S. Cl.
CPC ..... *C10M 143/02* (2013.01); *C10G 45/64* (2013.01); *C10M 169/041* (2013.01);
(Continued)

(58) Field of Classification Search
CPC ..... C10M 143/02; C10M 169/041; C10M 2203/003; C10M 2205/14; C10G 45/64; C10G 2300/302; C10G 2300/304; C10G 2300/308; C10G 2300/4006; C10G 2300/4012; C10G 2300/4018
See application file for complete search history.

(56) References Cited

U.S. PATENT DOCUMENTS 6,059,955 A 5/2000 Cody et al.
2003/0075477 A1 4/2003 Miller
(Continued)

FOREIGN PATENT DOCUMENTS

JP 2002-503752 A 2/2002
JP 2005-506411 A 3/2005
(Continued)

OTHER PUBLICATIONS

ISR issued in WIPO Patent Application No. PCT/IP2019/013333, dated Jun. 25, 2019, English translation.
(Continued)

*Primary Examiner* — Ellen M McAvoy
(74) *Attorney, Agent, or Firm* — Greenblum & Bernstein, P.L.C.

(57) ABSTRACT

The present invention provides a wax isomerized oil, wherein a content of a hydrocarbon compound having an even number of carbon atoms, as determined from a chromatogram obtained by mass spectrometry, is more than 50% by mass based on a total amount of the wax isomerized oil.

3 Claims, 10 Drawing Sheets

(52) U.S. Cl.
CPC . *C10G 2300/302* (2013.01); *C10G 2300/304* (2013.01); *C10G 2300/308* (2013.01); *C10G 2300/4006* (2013.01); *C10G 2300/4012* (2013.01); *C10G 2300/4018* (2013.01); *C10M 2203/003* (2013.01); *C10M 2205/14* (2013.01)

(56) References Cited

U.S. PATENT DOCUMENTS

| | | | | |
|---|---|---|---|---|
| 2004/0181110 | A1* | 9/2004 | Miller | C10M 177/00 585/739 |
| 2004/0256286 | A1* | 12/2004 | Miller | C10G 65/12 208/58 |
| 2005/0133409 | A1* | 6/2005 | Abernathy | C10G 45/64 208/27 |
| 2006/0113216 | A1* | 6/2006 | Rosenbaum | C10M 177/00 208/27 |
| 2006/0219597 | A1 | 10/2006 | Bishop et al. | |
| 2006/0289337 | A1* | 12/2006 | Rosenbaum | C10G 65/043 208/27 |
| 2007/0232503 | A1* | 10/2007 | Haigh | C10M 169/041 508/192 |
| 2008/0073248 | A1* | 3/2008 | Shah | C10G 2/30 208/18 |
| 2013/0012745 | A1* | 1/2013 | Knuuttila | B01J 23/74 585/240 |

FOREIGN PATENT DOCUMENTS

| | | | |
|---|---|---|---|
| JP | 2005-232284 | A | 9/2005 |
| JP | 2008-534772 | A | 8/2008 |
| WO | 99/040332 | A1 | 8/1999 |
| WO | 99/041332 | A1 | 8/1999 |
| WO | 03/033622 | A1 | 4/2003 |
| WO | 2006/130219 | A1 | 12/2006 |

OTHER PUBLICATIONS

Written Opinion issued in WIPO Patent Application No. PCT/JP2019/013333, dated Jun. 25, 2019, English translation.
IPRP issued in WIPO Patent Application No. PCT/JP2019/013333, dated Oct. 8, 2020, English translation.
IPRP issued in WIPO Patent Application No. PCT/JP2019/013333, dated Nov. 8, 2020, English translation.
IPRP issued in WIPO Patent Application No. PCT/JP2019/01333 1, dated Oct. 8, 2020, English translation.

* cited by examiner

WAX ISOMERIZED OIL

TECHNICAL FIELD

The present invention relates to a wax isomerized oil.

BACKGROUND ART

Conventionally, there has been wax isomerized oil in addition to mineral base oil, as lubricating base oil. As the examples of wax for a raw material of wax isomerized oil, natural wax such as petroleum slack wax obtained by solvent dewaxing of hydrocarbon oil, or synthetic wax such as one produced by Fischer Tropsch synthesis by use of synthetic gas (FT wax), are included. There is known, as a method for producing a wax isomerized oil low in viscosity and high in viscosity index, a method involving performing hydrotreatment of a raw material wax, isomerization of the hydrotreated wax, recover of a predetermined fraction by fractional distillation of an isomerized product and dewaxing of the fraction recovered, in the listed order (see, for example, Patent Literature 1).

CITATION LIST

Patent Literature

[Patent Literature 1] Japanese Unexamined Patent Publication No. 2002-503752

SUMMARY OF INVENTION

Technical Problem

While it is true that the wax isomerized oil low in viscosity and high in viscosity index, described in Patent Literature 1, is effective from the viewpoint of energy conservation properties, it has been found by studies of the present inventor that the wax isomerized oil still has room for improvements in terms of an enhancement in viscosity-temperature characteristics and a reduction in traction coefficient.

An object of the present invention is then to provide a wax isomerized oil having low traction coefficient and excellent viscosity-temperature characteristics.

Solution to Problem

The present invention provides a wax isomerized oil, wherein a content of a hydrocarbon compound having an even number of carbon atoms, as determined from a chromatogram obtained by mass spectrometry, is more than 50% by mass based on a total amount of the wax isomerized oil.

The content of the hydrocarbon compound having an even number of carbon atoms describe above may be 70% by mass or more based on the total amount of the wax isomerized oil.

The wax isomerized oil may be an isomerized oil of an ethylene polymer wax.

The wax isomerized oil may be an isomerized oil of an ethylene polymer wax not subjected to any hydrocracking treatment.

The wax isomerized oil may be an isomerized oil obtained by hydroisomerizing an ethylene polymer wax at a temperature of 315° C. or more and 350° C. or less, or may be an isomerized oil obtained by hydroisomerizing an ethylene polymer wax at a temperature of 325° C. or more and 335° C. or less.

Advantageous Effects of Invention

According to the present invention, there is provided a wax isomerized oil having excellent viscosity-temperature characteristics and low traction coefficient.

DESCRIPTION OF EMBODIMENTS

Figure 1:
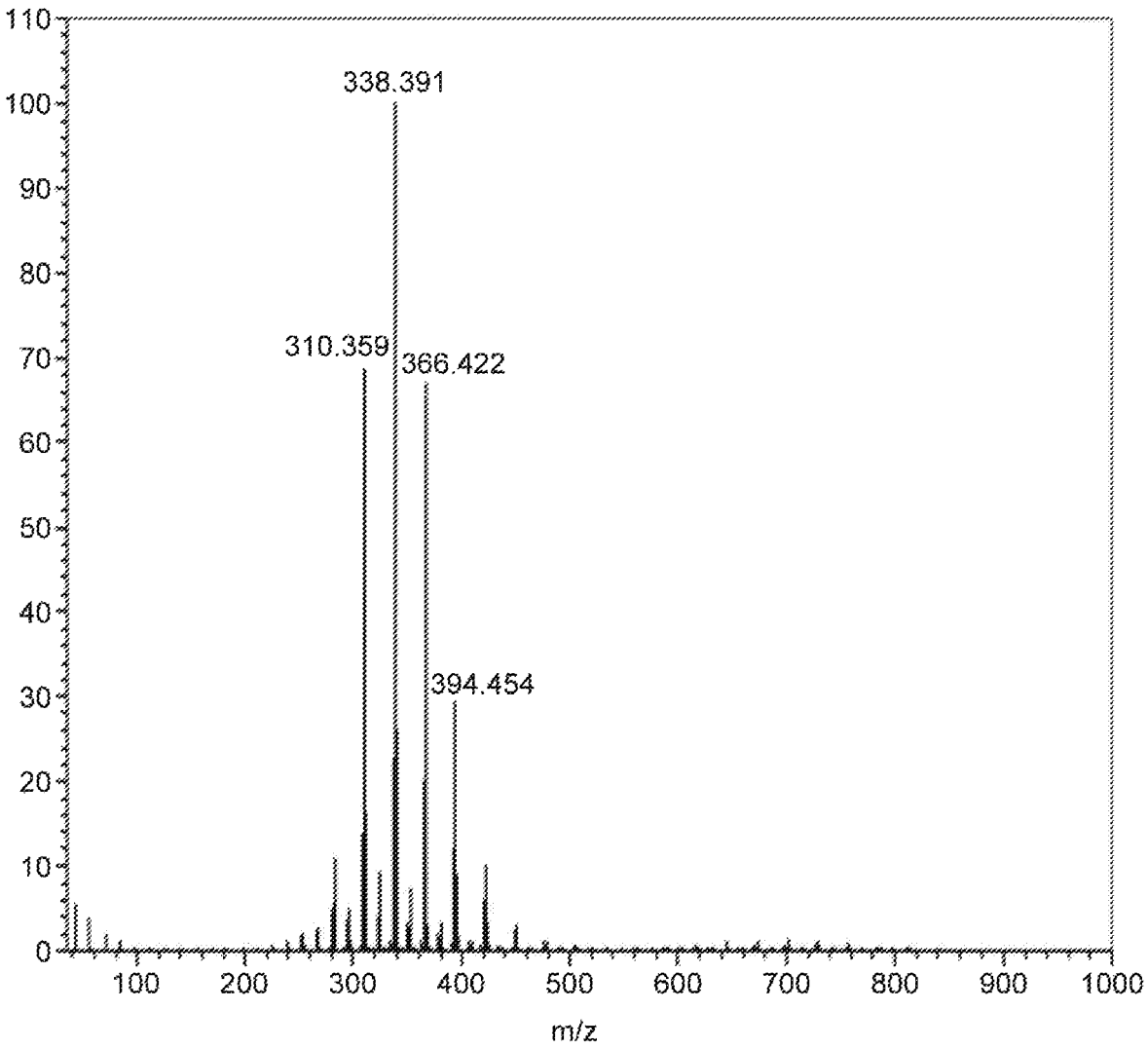
FIG. 1 A chromatogram obtained by performing Field Desorption-Mass Spectroscopy with respect to a wax isomerized oil obtained in Example 1-1.

Hereinafter, modes for carrying out the present invention will be described.

A wax isomerized oil according to the present embodiment is such that the content of a hydrocarbon compound having an even number of carbon atoms, as determined from a chromatogram by any mass analysis typified by, for example, Field Desorption-Mass Spectroscopy, is more than 50% by mass based on the total amount of the wax isomerized oil. Such a wax isomerized oil according to the present embodiment can be produced by, for example, a method comprising a step of providing an ethylene polymer wax not subjected to any hydrocracking treatment, and a step of isomerization dewaxing the ethylene polymer wax to obtain a wax isomerized oil. That is, the wax isomerized oil according to the present embodiment can also be referred to as an "isomerized oil of an ethylene polymer wax not subjected to any hydrocracking treatment."

The present inventor presumes that the reason why the wax isomerized oil according to the present embodiment is excellent in viscosity-temperature characteristics and exhibits a low traction coefficient is because of specificity of the carbon number distribution.

That is, first, in the case of a conventional wax isomerized oil, a raw material wax such as wax obtained by FT synthesis is usually a mixture of a hydrocarbon compound having an even number of carbon atoms (hydrocarbon compound having 2n carbon atoms; n represents an integer of 1 or more. The same applies hereinafter.) and a hydrocarbon compound having an odd number of carbon atoms (hydrocarbon compound having 2n+1 carbon atoms), and the ratio of both such hydrocarbon compounds are almost the same. While such hydrocarbon compounds can also be each changed in molecular structure due to cracking and/or isomerization in a wax isomerized oil obtained by the production method described in Patent Literature 1 (method involving performing hydrotreatment of a raw material wax, isomerization of the hydrotreated wax, recover of a predetermined fraction by fractional distillation of an isomerized product and dewaxing of the fraction recovered, in the listed order), there is not any case where the ratio of one of the hydrocarbon compound having 2n carbon atoms or the hydrocarbon compound having 2n+1 carbon atoms is extremely high as a whole.

On the contrary, the raw material wax in the present embodiment is an ethylene polymer wax, if necessary, subjected to a hydrocracking treatment, and is mostly a hydrocarbon compound having an even number of carbon atoms (hydrocarbon compound having 2n carbon atoms). In a case where the ethylene polymer wax is isomerization dewaxed, such isomerization can allow the change in molecular structure (production of, for example, isoparaffin having 2n−1 carbon atom(s) along with cleavage and isomerization of normal paraffin having 2n carbon atoms) to occur, and thus the resulting wax isomerized oil is a mixture of a hydrocarbon compound having an even number of carbon atoms or a hydrocarbon compound having an odd number of carbon atoms, and exhibits a specific carbon number distribution where the proportion of one of such hydrocarbon compounds is high. The reason why the wax isomerized oil according to the present embodiment is excellent in viscosity-temperature characteristics and exhibits a low traction coefficient as compared with a conventional wax isomerized oil equivalent in viscosity is considered because of specificity of such a carbon number distribution.

Examples of the ethylene polymer wax include ethylene oligomer wax obtained by oligomerization of ethylene. The "oligomer" in the present embodiment here means a polymer whose number average molecular weight (Mn) is 5000 or less. The Mn of such an ethylene oligomer is preferably 3000 or less, more preferably 1000 or less. The lower limit value of the Mn of the ethylene oligomer is not particularly limited, but is, for example, preferably 200 or more, more preferably 250 or more, further preferably 300 or more. The Mw/Mn representing the degree of molecular weight distribution is, for example, preferably 1.0 to 5.0, more preferably 1.1 to 3.0. When the Mn of the ethylene oligomer is 3000 or less, it is possible to efficiently obtain a desired base oil without any need for stringent isomerization conditions such as an increase in reaction temperature for obtaining a base oil of a targeted viscosity with the oligomer as a raw material. It is also possible to prevent an increase traction coefficient due to excess isomerization. On the other hand, when the Mn of the ethylene oligomer is 200 or more, it is possible to efficiently obtain a base oil of a targeted viscosity.

The Mn and Mw of the oligomer can be each determined as, for example, the molecular weight in terms of polystyrene based on the calibrated with standard polystyrene by use of a GPC apparatus.

A linear hydrocarbon compound is usually included in the ethylene polymer wax used as the raw material wax. The content of the linear hydrocarbon compound in the ethylene polymer wax is not particularly limited, and is, for example, preferably 40% by mass or more, more preferably 50% by mass or more, further preferably 60% by mass or more based on the total amount of the ethylene polymer wax. The upper limit of the content of the linear hydrocarbon compound is also not particularly limited, and is, for example, usually 100% by mass or less, preferably 90% by mass or less, more preferably 85% by mass or less.

The content of the hydrocarbon compound having an even number of carbon atoms with respect to the constitution of the hydrocarbon compounds included in the ethylene polymer wax is preferably 80% by mass or more, more preferably 90% by mass or more based on the total amount of the ethylene polymer wax. It is further preferable to include substantially no hydrocarbon compound having an odd number of carbon atoms, from the viewpoint of being capable of more effectively improving the viscosity-temperature characteristics and the traction coefficient of the resulting wax isomerized oil.

The content of the linear hydrocarbon compound described above means a value obtained by performing gas chromatographic analysis under the following conditions with respect to the ethylene polymer wax, and measuring and calculating the proportion of the linear hydrocarbon compound in the total amount of the ethylene polymer wax. A mixed sample of normal paraffin having 5 to 50 carbon atoms is here used as a standard sample in such measurement, and such a proportion is each determined as the total proportion of the peak area value corresponding to such normal paraffin relative to the total peak area of a chromatogram. In the case of hydrocarbon compounds having the same number of carbon atoms, a hydrocarbon compound having the highest boiling point (the longest distillation time) is here normal paraffin, and thus a peak present between the peak corresponding to the distillation time of normal paraffin having n carbon atom(s) and the peak corresponding to the distillation time of normal paraffin having n−1 carbon atom(s) in measurement of the above-described standard sample is defined to correspond to non-normal paraffin having n carbon atom(s), and normal paraffin and non-normal paraffin that are the same in the number of carbon atom(s) are distinguished from each other, in calculation of the number of carbon atoms.

(Gas Chromatography Conditions)

Column: liquid phase non-polar column (length: 25 mm, inner diameter: 0.3 mmϕ, thickness of liquid phase: 0.1 μm)

Temperature program: 50 to 400° C. (rate of temperature increase: 10° C./min)

Carrier gas: helium (linear speed: 40 cm/min)

Split ratio: 90/1

Injection volume of sample: 0.5 μL (injection volume of sample diluted with carbon disulfide 20-fold)

Detector: hydrogen flame ionization detector (FID)

The content of the hydrocarbon compound having an even number of carbon atoms means a value obtained by performing analysis according to Field Desorption-Mass Spectroscopy under the following conditions with respect to the ethylene polymer wax, and calculating the proportion of the hydrocarbon compound having an even number of carbon atoms in the total amount of the ethylene polymer wax, from the mass number in the resulting chromatogram.

(Field Desorption-Mass Spectroscopy conditions)

Apparatus: JEOL JMS-T300GC

Ionization method; FD (Field Desorption)

Ion source temperature: room temperature

Opposite electrode voltage: −10 kV

Emitter current: 6.4 mm/min

Spectrum recording interval: 0.4 sec

Measurement mass range: m/z 35 to 1600

The method for producing the ethylene polymer wax is not particularly limited, and the ethylene polymer wax can be obtained by, for example, polymerizing (oligomerizing) ethylene in the presence of an ethylene polymerization catalyst. Examples of specific one aspect include a method involving introducing ethylene into a reaction apparatus filled with a catalyst. The method for introducing ethylene into the reaction apparatus is not particularly limited.

A solvent may also be used in such a polymerization reaction. Examples of the solvent include aliphatic hydrocarbon-based solvents such as butane, pentane, hexane, heptane, octane, cyclohexane, methylcyclohexane and decalin; and aromatic hydrocarbon-based solvents such as tetralin, benzene, toluene and xylene. The catalyst can be dissolved in such a solvent to perform solution polymerization, slurry polymerization or the like.

The reaction temperature in the polymerization reaction is not particularly limited, and is, for example, preferably −50° C. to 100° C., more preferably −30° C. to 90° C., further preferably −20° C. to 80° C., particularly preferably −10° C. to 70° C., very preferably −5° C. to 60° C., most preferably 0° C. to 50° C. from the viewpoint of catalyst efficiency. When the reaction temperature is −50° C. or more, it is possible to suppress precipitation of a polymer produced with the catalyst activity being maintained, and when the reaction temperature is 100° C. or less, it is possible to suppress degradation of the catalyst. The reaction pressure is also not particularly limited, but is, for example, preferably 100 kPa to 5 MPa. The reaction time is also not particularly limited, but is, for example, preferably 1 minute to 24 hours, more preferably 5 minutes to 20 hours, further preferably 10 minutes to 19 hours, particularly preferably 20 minutes to 18 hours.

The ethylene polymerization catalyst is not particularly limited, and examples thereof include a catalyst including an iron compound represented by the following formula (1).

[Formula 1]

(1)

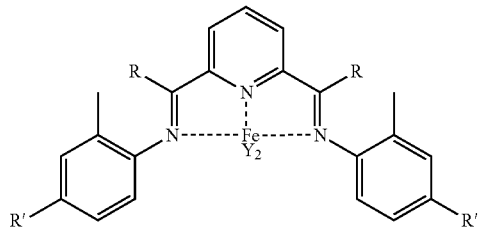

In the formula (1), R represents a hydrocarbyl group of 1 to 6 carbon atoms or an aromatic group of 6 to 12 carbon atoms, and a plurality of R in the same molecule may be the same or different. R' represents a free radical having an oxygen atom and/or a nitrogen atom, and a plurality of R' in the same molecule may be the same or different. Y represents a chlorine atom or a bromine atom.

Examples of the hydrocarbyl group of 1 to 6 carbon atoms include an alkyl group of 1 to 6 carbon atoms and an alkenyl group of 2 to 6 carbon atoms. The hydrocarbyl group may be any of a linear, branched or cyclic group. Furthermore, the hydrocarbyl group may be a monovalent group where a linear or branched hydrocarbyl group and a cyclic hydrocarbyl group are bonded.

Examples of the alkyl group of 1 to 6 carbon atoms include linear alkyl groups of 1 to 6 carbon atoms, such as a methyl group, an ethyl group, a n-propyl group, a n-butyl group, a n-pentyl group and a n-hexyl group; branched alkyl group of 3 to 6 carbon atoms, such as an iso-propyl group, an iso-butyl group, a sec-butyl group, a tert-butyl group, a branched pentyl group (including all structural isomers) and a branched hexyl group (including all structural isomers); and cyclic alkyl groups of 1 to 6 carbon atoms, such as a cyclopropyl group, a cyclobutyl group, a cyclopentyl group and a cyclohexyl group.

Examples of the alkenyl group of 2 to 6 carbon atoms include linear alkenyl groups of 2 to 6 carbon atoms, such as an ethenyl group (vinyl group), a n-propenyl group, a n-butenyl group, a n-pentenyl group and a n-hexenyl group; branched alkenyl groups of 2 to 6 carbon atoms, such as an iso-propenyl group, an iso-butenyl group, a sec-butenyl group, a tert-butenyl group, a branched pentenyl group (including all structural isomers) and a branched hexenyl group (including all structural isomers); and cyclic alkenyl groups of 2 to 6 carbon atoms, such as a cyclopropenyl group, a cyclobutenyl group, a cyclopentenyl group, a cyclopentadienyl group, a cyclohexenyl group and a cyclohexadienyl group.

Examples of the aromatic group of 6 to 12 carbon atoms include a phenyl group, a toluyl group, a xylyl group and a naphthyl group.

In the formula (1), a plurality of R and a plurality of R' in the same molecule may be the same or different. But they may be the same from the viewpoint of simplifying compound synthesis.

The free radical having an oxygen atom and/or a nitrogen atom may be a free radical of 0 to 6 carbon atoms having an oxygen atom and/or an nitrogen atom, and examples thereof include a methoxy group, an ethoxy group, an isopropoxy group and a nitro group.

Specific examples of such an iron compound include compounds represented by the following formulas (1a) to (1h). Such iron compounds can be used singly or in combinations of two or more thereof.

[Formula 2]

(1a)

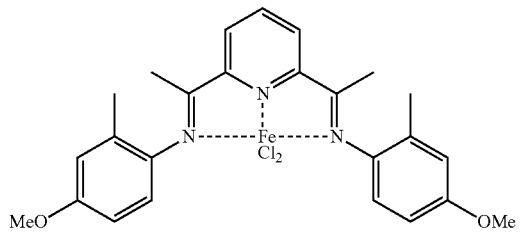

-continued

[Formula 3]

(1b)

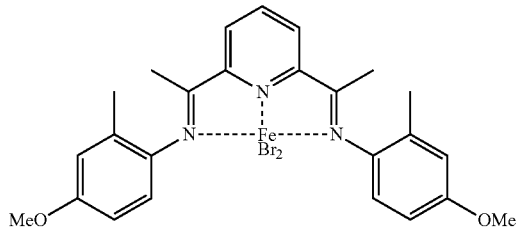

[Formula 4]

(1c)

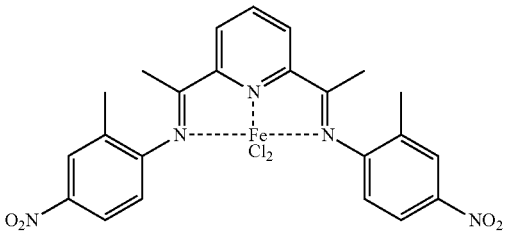

[Formula 5]

(1d)

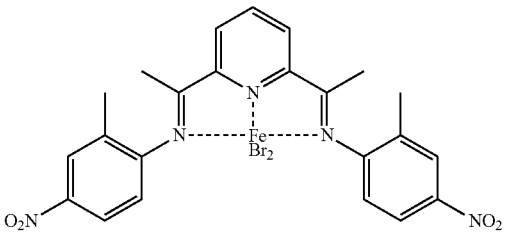

[Formula 6]

(1e)

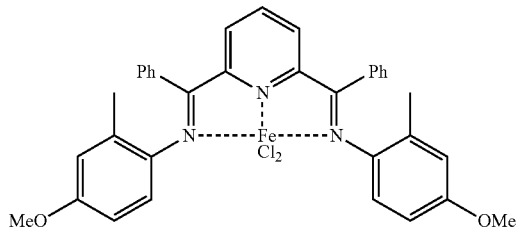

[Formula 7]

(1f)

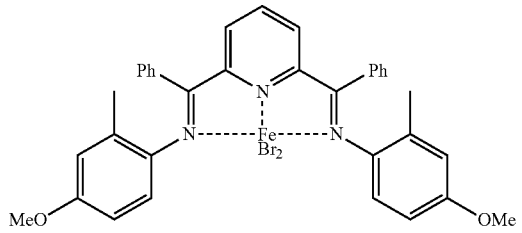

-continued

[Formula 8]

(1g)

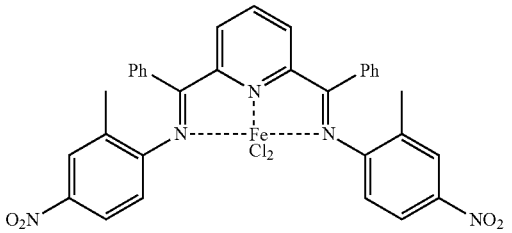

[Formula 9]

(1h)

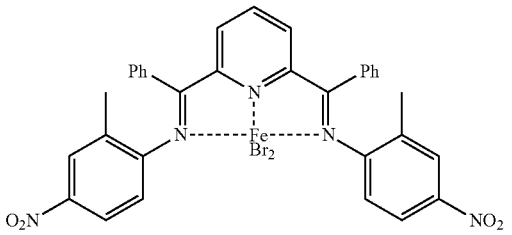

The compound (hereinafter, sometimes also referred to as "diimine compound") constituting a ligand in the iron compound represented by formula (1) can be obtained by, for example, performing condensation between dibenzoylpyridine and an aniline compound with eliminating water in the presence of an acid.

A preferable aspect of the method for producing the above-described diimine compound includes a first step of dissolving 2,6-dibenzoylpyridine, an aniline compound and an acid in a solvent and performing dehydration and condensation under heating and reflux of the solvent, and a second step of performing a separation/purification treatment of a reaction mixture after the first step, to obtain a diimine compound.

It is possible to use, for example, an organoaluminum compound as the acid used in the first step. Examples of the organoaluminum compound include trimethyl aluminum, triethyl aluminum, tripropyl aluminum, triisopropyl aluminum, tributyl aluminum, triisobutyl aluminum, trihexyl aluminum, trioctyl aluminum, diethyl aluminum chloride, ethyl aluminum dichloride, ethyl aluminum sesquichloride and methylaluminoxane.

It is also possible to use a protonic acid, besides the above-described organoaluminum compound, as the acid used in the first step. Such a protonic acid is used as an acid catalyst donating a proton. The protonic acid used is not particularly limited, but an organic acid is preferred. Examples of such a protonic acid are acetic acid, trifluoroacetic acid, methanesulfonic acid, trifluoromethanesulfonic acid and p-toluenesulfonic acid. In a case where such a protonic acid is used, it is preferable to remove water by a Dean-Stark water separator or the like, from the viewpoint of suppression of by-production of water. It is also possible to perform a reaction in the presence of an adsorbent such as molecular sieves. The amount of the protonic acid to be used is not particularly limited, but a catalytic amount may be enough.

Examples of the solvent used in the first step are a hydrocarbon-based solvent and an alcohol-based solvent. Examples of the hydrocarbon-based solvent are hexane, heptane, octane, benzene, toluene, xylene, cyclohexane and methylcyclohexane. Examples of the alcohol-based solvent are methanol, ethanol and isopropyl alcohol.

The reaction conditions in the first step can be appropriately selected depending on the types and amounts of the raw material compound, the acid and the solvent.

The separation/purification treatment in the second step is not particularly limited, and examples thereof include silica gel column chromatography and a recrystallization method. Especially, when the organoaluminum compound described above is used as the acid, it is preferable to make purification after mixing of a reaction solution with a basic aqueous solution to decompose and remove aluminum compound.

The method for mixing the diimine compound with iron is not particularly limited, and examples thereof are (i) a method involving adding and mixing a salt of iron (hereinafter, also sometimes simply referred to as "salt") to and with a solution where the diimine compound is dissolved, and (ii) a method involving physically mixing the diimine compound with such a salt without use of any solvent.

The method for taking out a complex from a mixture of the diimine compound with iron is not particularly limited, and examples thereof are (a) a method involving distilling off a solvent, if the solvent is used to prepare the mixture, to separate a solid by filtration, (b) a method involving separating a precipitate generated from the mixture by filtration, (c) a method involving adding a poor solvent to the mixture for purification and separating a precipitate by filtration, and (d) a method involving directly taking out a solvent-free mixture. Thereafter, the resultant mixture may be washed with a solvent dissolving the diimine compound, a solvent dissolving a metal, and a recrystallization with a proper solvent, and/or the like.

Examples of the salt of iron are iron(II) chloride, iron(III) chloride, iron(II) bromide, iron(III) bromide, acetylacetonate iron(II), acetylacetonate iron(III), iron(II) acetate and iron(III) acetate. The above-described a salt having a ligand such as a solvent or water may also be used. Among them, a salt of iron(II) is preferable, and iron(II) chloride is more preferable.

The solvent for mixing the diimine compound with iron is not particularly limited, and any of a non-polar solvent and a polar solvent can be used. Examples of the non-polar solvent are hydrocarbon-based solvents such as hexane, heptane, octane, benzene, toluene, xylene, cyclohexane and methylcyclohexane. Examples of the polar solvent are polar protonic solvents such as alcohol solvents and polar aprotic solvents such as tetrahydrofuran. Examples of the alcohol solvent are methanol, ethanol and isopropyl alcohol. Especially, when the mixture is used directly as a catalyst, it is preferable to use a hydrocarbon-based solvent having substantially no effect on an ethylene polymerization reaction.

When the diimine compound and iron are contacted, the mixing ratio thereof is not particularly limited. The ratio of diimine compound/iron compound is preferably 0.2/1 to 5/1, more preferably 0.3/1 to 3/1, further preferably 0.5/1 to 2/1, particularly preferably 1/1 on a molar ratio.

While it is preferable that two imine moieties in the diimine compound are both E-forms, a Z-form diimine may be included as a diimine compound where both imine moieties are E-forms. The diimine compound including a Z-form hardly forms a complex with a metal, and thus can be formed into a complex in a system and then easily removed in a purification step such as solvent washing.

An ethylene polymerization catalyst including the iron compound represented by the formula (1) may further contain an organoaluminum compound in order to allow a polymerization reaction to more efficiently progress. Examples of the organoaluminum compound are trimethyl aluminum and methylaluminoxane. The content ratio between the iron compound represented by formula (1) and the organoaluminum compound is preferably G:H=1:10 to 1:1000, more preferably 1:10 to 1:800, further preferably 1:20 to 1:600, particularly preferably 1:20 to 1:500 on a molar ratio in a case where the number of moles of the iron compound is designated as G and the number of moles of an aluminum atom in the organoaluminum compound is designated as H. When the ratio is in the above range, it is possible to suppress an increase in cost with a more sufficient polymerization activity being exhibited.

In a case where methylaluminoxane is used as the organoaluminum compound, it is possible to not only use a commercially available methylaluminoxane product diluted with a solvent, but also use trimethyl aluminum partially hydrolyzed in a solvent. It is also possible to use modified methylaluminoxane obtained by allowing trialkyl aluminum other than trimethyl aluminum, like triisobutyl aluminum, to coexist in partial hydrolysis of trimethyl aluminum and performing co-partial hydrolysis. Furthermore, in a case where unreacted trialkyl aluminum remains during the above-described partial hydrolysis, the unreacted trialkyl aluminum may be removed by distillation under reduced pressure. Modified methylaluminoxane obtained by modifying methylaluminoxane with an active proton compound such as phenol or a derivative thereof may also be used.

In a case where trimethyl aluminum and methylaluminoxane are used in combination in the organoaluminum compound, the content ratio between trimethyl aluminum and methylaluminoxane in the ethylene polymerization catalyst is preferably $H_1$:$H_2$=100:1 to 1:100, more preferably 50:1 to 1:50, further preferably 10:1 to 1:10 on a molar ratio in a case where the number of moles of trimethyl aluminum is designated as $H_1$ and the number of moles of an aluminum atom in methylaluminoxane is designated as $H_2$. When the ratio is in the above range, it is possible to suppress an increase in cost with a more sufficient catalyst efficiency being exhibited.

The ethylene polymerization catalyst including the iron compound represented by the formula (1) may further include a boron compound as an arbitrary component.

The boron compound has a function as a co-catalyst that further enhances the catalyst activity of the iron compound represented by the formula (1) in the ethylene polymerization reaction.

Examples of the boron compound include an aryl boron compound such as trispentafluorophenyl borane. It is possible to use a boron compound having anion species, as the boron compound. The examples are aryl borates such as tetrakispentafluorophenylborate and tetrakis(3,5-trifluoromethylphenyl)borate. Specific examples of such aryl borate are lithium tetrakispentafluorophenylborate, sodium tetrakispentafluorophenylborate, N,N-dimethylanilinium tetrakispentafluorophenylborate, trityl tetrakispentafluorophenylborate, lithium tetrakis(3,5-trifluoromethylphenyl)borate, sodium tetrakis(3,5-trifluoromethylphenyl)borate, N,N-dimethylanilinium tetrakis(3,5-trifluoromethylphenyl)borate and trityl tetrakis(3,5-trifluoromethylphenyl)borate. Among them, N,N-dimethylanilinium tetrakispentafluorophenylborate, trityl tetrakispentafluorophenylborate, N,N-dimethylanilinium tetrakis(3,5-trifluoromethylphenyl)borate or trityl tetrakis(3,5-trifluoromethylphenyl)borate is preferable. Such boron compounds can be used singly or in combinations of two or more thereof.

In a case where the organoaluminum compound and the boron compound are used in combination in the ethylene polymerization catalyst, the content ratio between the organoaluminum compound and the boron compound is preferably H:J=1000:1 to 1:1, more preferably 800:1 to 2:1, further preferably 600:1 to 10:1 on a molar ratio in a case where the number of moles of the organoaluminum compound is designated as H and the number of moles of the boron compound is designated as J. When the ratio is in the above range, it is possible to suppress an increase in cost with a more sufficient catalyst efficiency being exhibited.

The ethylene polymerization catalyst including the iron compound represented by the formula (1) may further contain a compound represented by the following formula (2) (hereinafter, sometimes also referred to as "ligand") from the viewpoint of ensuring a more sufficient catalyst efficiency by suppression of deactivation of the catalyst.

[Formula 10]

(2)

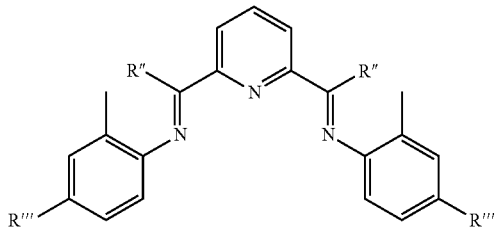

In the formula (2), R'' represents a hydrocarbyl group of 1 to 6 carbon atoms or an aromatic group of 6 to 12 carbon atoms, a plurality of R'' in the same molecule may be the same or different, R''' represents a free radical of 0 to 6 carbon atoms, the radical having an oxygen atom and/or an nitrogen atom, and a plurality of R''' in the same molecule may be the same or different.

Examples of the hydrocarbyl group of 1 to 6 carbon atoms are an alkyl group of 1 to 6 carbon atoms and an alkenyl group of 2 to 6 carbon atoms. The hydrocarbyl group may be any of a linear, branched or cyclic group. Furthermore, the hydrocarbyl group may be a monovalent group where a linear or branched hydrocarbyl group and a cyclic hydrocarbyl group are bonded.

Examples of the alkyl group of 1 to 6 carbon atoms are linear alkyl groups of 1 to 6 carbon atoms, such as a methyl group, an ethyl group, a n-propyl group, a n-butyl group, a n-pentyl group and a n-hexyl group; branched alkyl group of 3 to 6 carbon atoms, such as an iso-propyl group, an iso-butyl group, a sec-butyl group, a tert-butyl group, a branched pentyl group (including all structural isomers) and a branched hexyl group (including all structural isomers); and cyclic alkyl groups of 1 to 6 carbon atoms, such as a cyclopropyl group, a cyclobutyl group, a cyclopentyl group and a cyclohexyl group.

Examples of the alkenyl group of 2 to 6 carbon atoms are linear alkenyl groups of 2 to 6 carbon atoms, such as an ethenyl group (vinyl group), a n-propenyl group, a n-butenyl group, a n-pentenyl group and a n-hexenyl group; branched alkenyl groups of 2 to 6 carbon atoms, such as an iso-propenyl group, an iso-butenyl group, a sec-butenyl group, a tert-butenyl group, a branched pentenyl group (including all structural isomers) and a branched hexenyl group (including all structural isomers); and cyclic alkenyl groups of 2 to 6 carbon atoms, such as a cyclopropenyl group, a cyclobutenyl group, a cyclopentenyl group, a cyclopentadienyl group, a cyclohexenyl group and a cyclohexadienyl group.

Examples of the aromatic group of 6 to 12 carbon atoms are a phenyl group, a toluyl group, a xylyl group and a naphthyl group.

In the formula (2), a plurality of R'' and a plurality of R''' in the same molecule may be each the same or different. But they may be each the same from the viewpoint of simplifying compound synthesis.

The free radical having an oxygen atom and/or a nitrogen atom may be a free radical of 0 to 6 carbon atoms, the radical having an oxygen atom and/or a nitrogen atom, and examples thereof include a methoxy group, an ethoxy group, an isopropoxy group and a nitro group.

Specific examples of such a ligand include compounds represented by the following formulas (2a) to (2d). Such ligands can be used singly or in combinations of two or more thereof.

[Formula 11]

(2a)

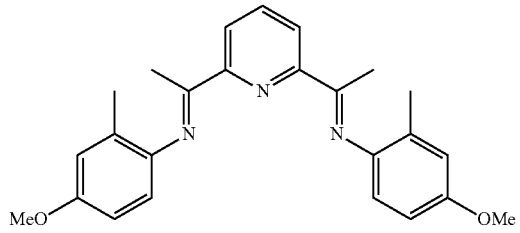

[Formula 12]

(2b)

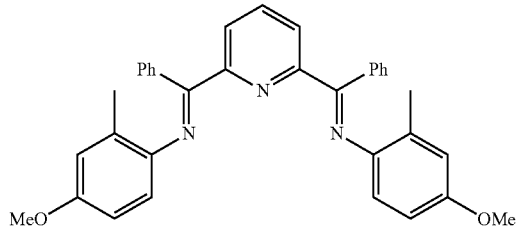

[Formula 13]

(2C)

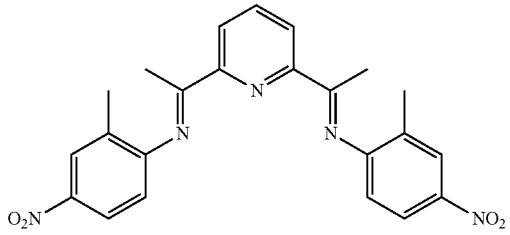

-continued

[Formula 14]

(2d)

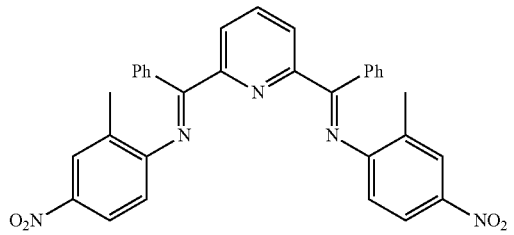

R in the formula (1) and R" in the formula (2), and R' in the formula (1) and R" in the formula (2), in the iron compound represented by the above-described formula (1) and the compound represented by the above-described formula (2) included in the ethylene polymerization catalyst in the present embodiment, may be each the same or different, and are preferably each the same from the viewpoint of allowing the same performance as in the iron compound represented by the formula (1) to be maintained.

In a case where the above-described ligand is included in the ethylene polymerization catalyst in the present embodiment, the content ratio between the iron compound and the ligand is not particularly limited. The ratio of ligand/iron compound is preferably 1/100 to 100/1, more preferably 1/20 to 50/1, further preferably 1/10 to 10/1, particularly preferably 1/5 to 5/1, very preferably 1/3 to 3/1 on a molar ratio. When the ratio of ligand/iron compound is 1/100 or more, it is possible to more enhance the catalyst efficiency by suppression of deactivation of the catalyst, and when the ratio is 100/1 or less, it is possible to suppress the cost with the effect of addition of the ligand being exerted.

The above-described method for producing the ethylene polymerization catalyst is not particularly limited, and, in a case where the ethylene polymerization catalyst includes the iron compound represented by the formula (1) and the organoaluminum compound, examples include a method involving adding and mixing a solution including the organoaluminum compound to and with a solution including the iron compound represented by the formula (1) and a method involving adding and mixing a solution including the iron compound represented by the formula (1) to and with a solution including the organoaluminum compound. For example, in a case where the above-described boron compound and the ligand are further included besides the iron compound represented by the formula (1) and the organoaluminum compound, all the components may be contacted collectively or may be contacted in any order. Examples of the method for producing the ethylene polymerization catalyst in the present embodiment include (A) a method involving mixing a solution including the iron compound represented by the formula (1) and a solution including the boron compound, and then contacting the resulting mixture with the organoaluminum compound, (B) a method involving mixing a solution including the iron compound represented by the formula (1) and a solution including the organoaluminum compound, and then contacting the resulting mixture with the boron compound, (C) a method involving mixing a solution including the boron compound and a solution including the organoaluminum compound, and then contacting the resulting mixture with the iron compound represented by the formula (1), (D) a method involving mixing a solution including the iron compound represented by the formula (1) and a solution including the ligand, and then contacting the resulting mixture with the organoaluminum compound, (E) a method involving mixing a solution including the iron compound represented by the formula (1) and a solution including the organoaluminum compound, and then contacting the resulting mixture with the ligand, (F) a method involving mixing a solution including the organoaluminum compound and a solution including the ligand, and then contacting the resulting mixture with the iron compound represented by the formula (1), (G) a method involving mixing a solution including the iron compound represented by the formula (1) and a solution including the boron compound, then adding and mixing a solution including the organoaluminum compound thereto and therewith, and then contacting the resulting mixture with the ligand, (H) a method involving mixing a solution including the iron compound represented by the formula (1) and a solution including the boron compound, then adding and mixing a solution including the ligand thereto and therewith, and then contacting the resulting mixture with the organoaluminum compound, (I) a method involving mixing a solution including the iron compound represented by the formula (1) and a solution including the organoaluminum compound, then adding and mixing a solution including the boron compound thereto and therewith, and then contacting the resulting mixture with the ligand, (J) a method involving mixing a solution including the iron compound represented by the formula (1) and a solution including the organoaluminum compound, then adding and mixing a solution including the ligand thereto and therewith, and then contacting the resulting mixture with the boron compound, (K) a method involving mixing a solution including the iron compound represented by the formula (1) and a solution including the ligand, then adding and mixing a solution including the organoaluminum compound thereto and therewith, and then contacting the resulting mixture with the boron compound, (L) a method involving mixing a solution including the iron compound represented by the formula (1) and a solution including the ligand, then adding and mixing a solution including the boron compound thereto and therewith, and then contacting the resulting mixture with the organoaluminum compound, (M) a method involving mixing a solution including the boron compound and a solution including the organoaluminum compound, then adding and mixing a solution including the iron compound represented by the formula (1) thereto and therewith, and then contacting the resulting mixture with the ligand, (N) a method involving mixing a solution including the boron compound and a solution including the organoaluminum compound, then adding and mixing a solution including the ligand thereto and therewith, and then contacting the resulting mixture with the iron compound represented by the formula (1), (O) a method involving mixing a solution including the boron compound and a solution including the ligand, then adding and mixing a solution including the iron compound represented by the formula (1) thereto and therewith, and then contacting the resulting mixture with the organoaluminum compound, (P) a method involving mixing a solution including the boron compound and a solution including the ligand, then adding and mixing a solution including the organoaluminum compound thereto and therewith, and then contacting the resulting mixture with the iron compound represented by the formula (1), (Q) a method involving mixing a solution including the organoaluminum compound and a solution including the ligand, then adding and mixing a solution including the iron compound represented by the formula (1) thereto and therewith, and then contacting the resulting mixture with the boron compound, (R) a method involving mixing a solution including the organoaluminum compound and a solution including the ligand, then adding and mixing a solution including the boron compound thereto and therewith, and then contacting the resulting mixture with the iron compound represented by the formula (1), (S) a method involving contacting the boron compound with a solution including the iron compound represented by the formula (1), and then adding and mixing a solution including the organoaluminum compound thereto and therewith, and (T) a method involving contacting the boron compound with a solution including the iron compound represented by the formula (1), then adding and mixing a solution including trimethyl aluminum thereto and therewith, and then contacting the resulting mixture with methylaluminoxane.

It is possible to obtain the wax isomerized oil by using the above-described ethylene polymer wax as a raw material and subjecting the raw material to, if necessary, a hydrocracking treatment, and furthermore isomerization dewaxing. The hydrocracking treatment is optionally made, and it is also possible to obtain the wax isomerized oil by using the ethylene polymer wax as a raw material and performing isomerization dewaxing without performing any hydrocracking treatment.

The hydrocracking treatment is a step capable of hydrocracking the above-described ethylene polymer wax by a hydrocracking catalyst to obtain a cracked product. Examples of the hydrocracking catalyst include respective catalysts containing a Group 6 metal, a Group 8 to 10 metal, and a mixture thereof. Examples of a preferable metal include nickel, tungsten, molybdenum, cobalt, and a mixture thereof. The hydrocracking catalyst can be used in a mode where such a metal is supported on a heat-resistant metal oxide carrier, and the metal is usually present, as oxide or sulfide, on the carrier. In a case where the above-described metal mixture is used, there may be present as a bulk metal catalyst where the amount of metals is 30% by mass or more based on the total amount of the catalyst. Examples of the metal oxide carrier include oxides such as silica, alumina, silica-alumina or titania, and in particular, alumina is preferable. Preferable alumina is γ or β porous alumina. The amount of the metal to be supported is preferably in the range from 0.5 to 35% by mass based on the total amount of the catalyst. In a case where a mixture of any of a Group 9 to 10 metal and a Group 6 metal is used, it is preferable that any Group 9 or 10 metal be present in an amount of 0.1 to 5% by mass and a Group 6 metal be present in an amount of 5 to 30% by mass based on the total amount of the catalyst. The amount of the metal to be supported may be measured by atomic absorption spectrometry, inductively coupled plasma optical emission spectrometry, or other method prescribed in ASTM with respect to each metal.

The acidity of the metal oxide carrier can be controlled by addition of an additional substance, control of properties of the metal oxide carrier (for example, control of the amount of silica to be incorporated into a silica-alumina carrier), and/or the like. Examples of the additional substance include halogen, in particular, fluorine, phosphorus, boron, yttria, alkali metals, alkaline earth metals, rare-earth oxide, and magnesia. While a co-catalyst like halogen generally increases the acidity of the metal oxide carrier, a weak basic additional substance like yttria or magnesia tends to decrease the acidity of such a carrier.

With respect to the hydrocracking treatment conditions, the treatment temperature is preferably 150 to 450° C., more preferably 200 to 400° C., the hydrogen partial pressure is preferably 1400 to 20000 kPa, more preferably 2800 to 14000 kPa, the liquid hourly space velocity (LHSV) is preferably 0.1 to 10 $hr^{-1}$, more preferably 0.1 to 5 $hr^{-1}$, and the hydrogen/oil ratio is preferably 50 to 1780 $m^3/m^3$, more preferably 89 to 890 $m^3/m^3$. The above-described conditions are merely examples, and it is preferable for the hydrocracking treatment conditions to be appropriately selected depending on the differences in raw material, catalyst, apparatus, and the like.

The isomerization dewaxing is to contact the ethylene polymer wax with a hydroisomerization catalyst in the presence of hydrogen (molecular hydrogen) and thus dewax a raw material by hydroisomerization. Examples of the hydroisomerization here include conversion of olefins to paraffin by hydrogenation, besides isomerization of normal paraffin to isoparaffin.

The hydroisomerization catalyst may include any of crystalline or amorphous material. Examples of the crystalline material include a molecular sieve having 10- or 12-membered ring channels mainly made of aluminosilicate (zeolite) or silicoaluminophosphate (SAPO). Specific examples of the zeolite include ZSM-22, ZSM-23, ZSM-35, ZSM-48, ZSM-57, Ferrierite, ITQ-13, MCM-68 and MCM-71. Examples of the aluminophosphate include ECR-42. Examples of the molecular sieve include zeolite beta and MCM-68. Among them, it is preferable to use one or two or more selected from ZSM-48, ZSM-22 and ZSM-23, and ZSM-48 is particularly preferable. The molecular sieve is preferably a hydrogen type. Reduction of the hydroisomerization catalyst can occur on site in the hydroisomerization, and a hydroisomerization catalyst subjected to a reductive treatment in advance may be subjected to the hydroisomerization.

Examples of the amorphous material of the hydroisomerization catalyst include alumina doped with a Group 3 metal, fluorinated alumina, silica-alumina, and fluorinated silica-alumina.

Examples of a preferable aspect of the hydroisomerization catalyst include bifunctional one, namely, one where a metal hydrogenation component being at least one Group 6 metal, at least one Group 8 to 10 metal, or a mixture thereof is attached. A preferable metal is a Group 9 or 10 noble metal such as Pt, Pd or a mixture thereof. The amount of such a metal to be attached is preferably 0.1 to 30% by mass based on the total amount of the catalyst. Examples of the methods of catalyst preparation and metal attachment include an ion-exchange method and an impregnation method each using a decomposable metal salt, respectively.

In a case where the molecular sieve is used, a composite with a binder material having heat resistance under the hydroisomerization conditions may be formed, or no binder (self-binding) may be used. Examples of the binder material include inorganic oxides including two-component combinations with other metal oxide such as silica, alumina, silica-alumina, silica and titania, magnesia, thoria, and zirconia, and three-component combinations of oxides, such as silica-alumina-thoria and silica-alumina-magnesia. The amount of the molecular sieve in the hydroisomerization catalyst is preferably 10 to 100% by mass, more preferably 35 to 100% by mass based on the total amount of the catalyst. The hydroisomerization catalyst is formed by a method such as spray-drying or extrusion. The hydroisomerization catalyst can be used in a sulfide or non-sulfide mode, preferably a sulfide mode.

With respect to the hydroisomerization conditions, the temperature is preferably 250 to 400° C., more preferably 275 to 360° C., further preferably 315 to 350° C., particularly preferably 325 to 335° C., the hydrogen partial pressure is preferably 791 to 20786 kPa (100 to 3000 psig), more preferably 1480 to 17339 kPa (200 to 2500 psig), the liquid hourly space velocity is preferably 0.1 to 10 $hr^{-1}$, more preferably 0.1 to 5 $hr^{-1}$, and the hydrogen/oil ratio is preferably 45 to 1780 $m^3/m^3$ (250 to 10000 scf/B), more preferably 89 to 890 $m^3/m^3$ (500 to 5000 scf/B). The above conditions are merely examples, and it is preferable for the hydroisomerization conditions to be appropriately selected depending on the differences in raw material, catalyst, apparatus, and the like, and characteristics of a desired base oil.

The production method in the present embodiment may comprise, before performing the above-described isomerization dewaxing with respect to the ethylene polymer wax, a step (raw material distillation step) of fractionally distilling the wax. The fraction obtained by undergoing the raw material distillation step can be subjected, as treated oil, to the isomerization dewaxing, thereby allowing a wax isomerized oil of an objective viscosity grade to be efficiently obtained.

The boiling point range of the fraction in the raw material distillation step can be appropriately adjusted. The boiling point range of the fraction can be adjusted to, for example, fractionally distill a fraction whose boiling point range is 250 to 500° C. Furthermore, in a case where a wax isomerized oil corresponding to 70Pale, SAE-10 or VG6 is obtained, the boiling point range of each fraction can be as follows.

70Pale: fraction whose boiling point range is 300 to 460° C.

SAE-10: fraction whose boiling point range is 360 to 500° C.

VG6: fraction whose boiling point range is 250 to 440° C.

For example, the boiling point range being 250 to 500° C. indicates that the initial boiling point and the end point are in the range from 250 to 500° C.

The distillation conditions in the raw material distillation step are not particularly limited as long as there are conditions that enable an objective fraction to be fractionally distilled from the ethylene polymer wax. For example, the raw material distillation step may be a step of fractionally distilling by distillation under reduced pressure, or may be a step of fractionally distilling with a combination of distillation at ambient pressure (or distillation under pressure) and distillation under reduced pressure. For example, a single fraction may be fractionally distilled or a plurality of fractions depending on the viscosity grade may be fractionally distilled, from the ethylene polymer wax in the raw material distillation step.

A wax isomerized oil where the ethylene polymer wax is isomerized to isoparaffin by the above-described isomerization dewaxing may be, if desired, subjected to hydrorefining or may be fractionally distilled to a fraction having a desired viscosity grade.

For example, olefins in the wax isomerized oil are hydrogenated by hydrorefining, and oxidation stability and hue of a lubricating oil are improved. Such hydrorefining can be performed by, for example, using a hydrorefining catalyst.

It is preferable that the hydrorefining catalyst be one obtained by supporting a Group 6 metal, a Group 8 to 10 metal, or a mixture thereof on the metal oxide carrier. Example of a preferable metal is a noble metal, particularly platinum, palladium, and a mixture thereof. In a case where such a metal mixture is used, there may be present as a bulk metal catalyst where the amount of metals is 30% by mass or more based on that of the catalyst. It is preferable that the content of the non-noble metals in the catalyst is 20% by mass or less and that of noble metals in the catalyst is 1% by mass or less. The metal oxide carrier may be either amorphous or crystal. Specific examples include weak-acidic oxides such as silica, alumina, silica-alumina or titania, and alumina is preferable. It is preferable to use a hydrorefining catalyst where a metal having a relatively strong hydrogenation function is supported on a porous carrier, from the viewpoint of saturation of an aromatic compound.

Examples of a preferable hydrorefining catalyst include a mesoporous material belonging to an M41S class or a series of catalysts thereof. A series of M41S catalysts are each a mesoporous material having a high content rate of silica, and specific examples thereof include MCM-41, MCM-48 and MCM-50. Such a hydrorefining catalyst has a pore size of 15 to 100 Å, and MCM-41 is particularly preferable. MCM-41 corresponds to an inorganic, porous non-layered phase having a hexagonal arrangement of evenly sized pores. The physical structure of MCM-41 is like a bundle of straws where the diameter of a straw opening (the cell diameter of a pore) is in the range from 15 to 100 Å. MCM-48 has a cubic symmetry and MCM-50 has a layered structure. MCM-41 can be produced with pore openings different in size falling within a mesoporous range. The mesoporous material may have a metal hydrogenation component being at least one Group 8, 9 or 10 metal, and the metal hydrogenation component is preferably a noble metal, particularly a Group 10 noble metal, most preferably Pt, Pd, or a mixture thereof.

With respect to the hydrorefining conditions, the temperature is preferably 150 to 350° C., more preferably 180 to 250° C., the total pressure is preferably 2859 to 20786 kPa (about 400 to 3000 psig), the liquid hourly space velocity is preferably 0.1 to 5 $hr^{-1}$, more preferably 0.5 to 3 $hr^{-1}$, and the hydrogen/oil ratio is preferably 44.5 to 1780 $m^3/m^3$ (250 to 10,000 scf/B). The above conditions are merely examples, and it is preferable for the hydrorefining conditions to be appropriately selected depending on the differences in raw material and treatment apparatus.

In a case where the wax isomerized oil is fractionally distilled to a fraction having a desired viscosity grade, the distillation conditions are not particularly limited, and it is preferable to be performed by, for example, distillation at normal pressure (or distillation under pressure) for distilling off a light fraction from the wax isomerized oil, and distillation under reduced pressure for fractionally distilling a desired fraction from a bottom oil in the distillation at normal pressure.

When a bottom oil, obtained by distillation of the wax isomerized oil under ambient pressure (or pressurized condition), is distilled under reduced pressure, it is possible in distillation to obtain a plurality of lubricating oil fractions by setting a plurality of cut points. Examples include a method collecting a fraction whose boiling point range at normal pressure is 330 to 410° C., with a kinetic viscosity at 100° C. of 2.7 $mm^2/s$ as a targeted value, in order to acquire a wax isomerized oil corresponding to 70Pale suitable as a lubricating base oil for ATF or a shock absorber fluid; a method collecting a fraction whose boiling point range at normal pressure is 410 to 460° C., with a kinematic viscosity at 100° C. of 4.0 $mm^2/s$ as a targeted value, in order to acquire a lubricating base oil corresponding to SAE10 suitable as a lubricating base oil for an engine oil satisfying the standard of the API group III; and a method collecting a fraction whose boiling point range is 330° C. or less, with a kinematic viscosity at 100° C. of 2.0 $mm^2/s$ as a targeted value, in order to acquire a wax isomerized oil corresponding to VG6.

The wax isomerized oil according to the present embodiment is excellent in viscosity-temperature characteristics and exhibits a low traction coefficient, as compared with a conventional wax isomerized oil equivalent in viscosity.

The viscosity grade of the wax isomerized oil, according to the present embodiment, is not particularly limited, and the kinematic viscosity at 100° C. is preferably 1.5 $mm^2/s$ or more, more preferably 1.8 $mm^2/s$ or more, further preferably 2.0 $mm^2/s$ or more. On the other hand, the upper limit of the kinematic viscosity at 100° C. has particularly no limitation, but is preferably 20 $mm^2/s$ or less, more preferably 15 $mm^2/s$ or less, further preferably 10 $mm^2/s$ or less, particularly preferably 4 $mm^2/s$ or less.

It is possible in the present embodiment to separately take and use a wax isomerized oil whose kinematic viscosity at 100° C. is in the following range, by distillation or the like.

(I) a wax isomerized oil whose kinematic viscosity at 100° C. is 1.5 $mm^2/s$ or more and less than 2.3 $mm^2/s$, more preferably 1.8 mm to 2.1 $mm^2/s$ (II) a wax isomerized oil whose kinematic viscosity at 100° C. is 2.3 $mm^2/s$ or more and less than 3.0 $mm^2/s$, more preferably 2.4 to 2.8 $mm^2/s$ (III) a wax isomerized oil whose kinematic viscosity at 100° C. is 3.0 to 20 $mm^2/s$, more preferably 3.2 to 11 $mm^2/s$, further preferably 3.5 to 5 $mm^2/s$, particularly preferably 3.6 to 4 $mm^2/s$ The traction coefficient of the wax isomerized oil in the present embodiment is measured by using a steel ball and a steel disc as test pieces under conditions of a load of 20 N, a test oil temperature of 25° C., a circumferential velocity of 0.52 m/s and a slip ratio of 3%.

The wax isomerized oil according to the present embodiment can have low traction coefficient. The traction coefficient of the wax isomerized oil according to the present embodiment can be appropriately selected depending on the viscosity grade, and, for example, the traction coefficient of the wax isomerized oil (I) is preferably 0.0023 or less, more preferably 0.0020 or less. The traction coefficient of the wax isomerized oil (II) is preferably 0.0026 or less, more preferably 0.0023 or less, further preferably 0.0021 or less. The traction coefficient of the above-described wax isomerized oil (III) is preferably 0.0025 or less, more preferably 0.0023 or less. When the traction coefficient is in the above-described numerical value range, it is preferable from the viewpoint of energy conservation properties because it is possible to ensure low friction properties. On the other hand, the lower limit of the traction coefficient has no limit, but may be, for example, 0.001 or more.

The viscosity index of the wax isomerized oil according to the present embodiment can be appropriately selected depending on the viscosity grade. For example, the above-described viscosity index of the isomerized oil (I) is preferably 130 to 150. The above-described viscosity index of the isomerized oil (II) is preferably 135 to 160. The above-described viscosity index of the isomerized oil (III) is preferably 145 to 180. When the viscosity index is in the above-described range, it is preferable from the viewpoint of energy conservation properties because it is possible to ensure excellent viscosity-temperature characteristics. The viscosity index mentioned in the present invention means a viscosity index measured according to JIS K 2283-1993.

The density at 15° C. ($\rho_{15}$, unit: $g/cm^3$) of the wax isomerized oil, according to the present embodiment, can be appropriately selected depending on the viscosity grade. For example, the $\rho_{15}$ of the above-described isomerized oil (I) is preferably 0.82 $g/cm^3$ or less, more preferably 0.81 $g/cm^3$ or less, further preferably 0.80 $g/cm^3$ or less, particularly preferably 0.79 $g/cm^3$ or less. The $\rho_{15}$ of the above-described isomerized oils (II) and (III) is preferably 0.84 $g/cm^3$ or less, more preferably 0.83 $g/cm^3$ or less, further preferably 0.82 $g/cm^3$ or less. When the density at 15° C. is in the above-described range, not only viscosity-temperature characteristics and heat-oxidation stability, but also volatilization preventing properties and low-temperature viscosity characteristics are excellent, and, in a case where an additive is compounded into the wax isomerized oil, it is possible to sufficiently ensure the efficacy of the additive. The density at 15° C. mentioned in the present invention means a density measured at 15° C. according to JIS K 2249-1995.

The pour point of the wax isomerized oil according to the present embodiment can be appropriately selected depending on the viscosity grade. For example, the pour point of the above-described isomerized oil (I) is preferably −10° C. or less, more preferably −20° C. or less, further preferably −30° C. or less. The pour point of the above-described isomerized oil (II) is preferably −10° C. or less, more preferably −15° C. or less, further preferably −20° C. or less. The pour point of the above-described isomerized oil (III) is preferably −10° C. or less, more preferably −15° C. or less. When the pour point of the isomerized oil is in the above-described numerical value range, it is preferable from the viewpoint of energy conservation properties because it is possible to sufficiently ensure low-temperature fluidity of a lubricating oil using the isomerized oil. The pour point mentioned in the present invention means a pour point measured according to JIS K 2269-1987.

The cloud point of the wax isomerized oil, according to the present embodiment, depends on the viscosity grade, and the cloud point of the above-described wax isomerized oil (I), is, for example, preferably −15° C. or less, more preferably −17.5° C. or less. The cloud point of the above-described wax isomerized oil (II) is preferably −10° C. or less, more preferably −12.5° C. or less. The cloud point of the above-described wax isomerized oil (III) is preferably −10° C. or less. When the cloud point of the wax isomerized oil is in the above-described numerical value range, it is preferable from the viewpoint of energy conservation properties because it is possible to sufficiently ensure low-temperature fluidity of a lubricating oil using the wax isomerized oil. The cloud point mentioned in the present invention means a cloud point measured according to "4. Testing method for testing cloud point" in JIS K 2269-1987.

Furthermore, in a case where mass analysis is performed with respect to the wax isomerized oil, according to the present embodiment, the carbon number distribution of the hydrocarbon compound included in the wax isomerized oil can be appropriately selected depending on the viscosity grade. For example, the carbon number distribution in the above-described wax isomerized oil (I) is preferably 10 to 40, more preferably 15 to 35. The carbon number distribution in the above-described wax isomerized oil (II) is preferably 12 to 45, more preferably 15 to 40. The carbon number distribution in the above-described wax isomerized oil (III) is preferably 15 to 55, more preferably 18 to 50.

In a case where mass analysis is performed with respect to the wax isomerized oil according to the present embodiment, the average number of carbon atoms of the hydrocarbon compound included in the wax isomerized oil can be appropriately selected depending on the viscosity grade. For example, the average number of carbon atoms in the above-described wax isomerized oil (I) is preferably 15 to 25, more preferably 18 to 22. The average number of carbon atoms in the above-described wax isomerized oil (II) is preferably 15 to 35, more preferably 20 to 30. The average number of carbon atoms in the above-described wax isomerized oil (III) is preferably 20 to 40, more preferably 25 to 35. The density, the viscosity, the carbon number distribution, and the average number of carbon atoms are adjusted to appropriate ranges as above to thereby make it possible to obtain an isomerized oil balanced which is low in pour point and traction coefficient and high in viscosity index.

The wax isomerized oil according to the present embodiment is obtained by isomerization dewaxing the ethylene polymer wax, as described above, and most of the constituent hydrocarbon compounds of the ethylene polymer wax correspond to the hydrocarbon compound having an even number of carbon atoms. Accordingly, the wax isomerized oil is not evenly balanced in contents of the hydrocarbon compound having an even number of carbon atoms and the hydrocarbon compound having an odd number of carbon atoms. That is, a specific content of the hydrocarbon compound having an even number of carbon atoms with respect to the constitution of such hydrocarbon compounds included in the wax isomerized oil needs to be more than 50% by mass based on the total amount of the wax isomerized oil, and is preferably 60% by mass or more, more preferably 70% by mass or more, further preferably 80% by mass or more, particularly preferably 85% by mass or more.

The carbon number distribution and the average number of carbon atoms described above are respective values determined by performing mass analysis with respect to the wax isomerized oil. FIG. 1 is a FD-MS chromatogram of an isomerized oil obtained in Example 1-1, and, for example, a peak around MS338 ($C_{24}H_{50}$) is defined as C24 and a peak around MS310 ($C_{22}H_{46}$) is defined as C22. A peak around MS324 ($C_{23}H_{48}$) corresponds to C23. The average number of carbon atoms is determined by adding such adjacent ion intensities to afford the content with respect to such each number of carbon atoms, and dividing the content by the entire amount. The carbon number distribution is determined from the beginning and the ending of the chromatogram.

The content of the above-described hydrocarbon compound having an even number of carbon atoms means a value obtained by performing mass spectrometry analysis with respect to the wax isomerized oil, and measuring and calculating the proportion of the hydrocarbon compound having an even number of carbon atoms in the total amount of the wax isomerized oil.

The wax isomerized oil according to the present embodiment is excellent in energy conservation properties, and can be preferably used as a lubricating base oil for various applications. Specific examples of such an application of the wax isomerized oil according to the present embodiment include a lubricating oil (lubricating oil for an internal combustion engine) for use in an internal combustion engine such as a gasoline engine for a passenger automobile, a gasoline engine for a two-wheeled vehicle, a diesel engine, a gas engine, an engine for a gas heat pump, a marine engine or an electrical generation engine, a lubricating oil (oil for a drive transmission apparatus) for use in a drive transmission apparatus such as an automatic transmission, a manual transmission, a continuously variable transmission or a final reduction gear, a hydraulic oil for use in a hydraulic apparatus such as a shock absorber or a construction machine, and a compressor oil, a turbine oil, an industrial gear oil, a refrigerator oil, a rust-proof oil, a heat medium oil, a gas holder sealing oil, a bearing oil, a paper machine oil, a working machine oil, a slip guide surface oil, an electrical insulating oil, a cutting oil, a press oil, a rolling oil and a heat treatment oil. The wax isomerized oil according to the present embodiment is used for such an application to thereby make it possible to achieve enhancements in properties such as energy conservation properties of each lubricating oil.

The wax isomerized oil according to the present embodiment may be used alone as the lubricating base oil or the wax isomerized oil according to the present embodiment may be used in combination with other one or two or more base oils, in the above applications. In a case where the wax isomerized oil according to the present embodiment is used in combination with other base oil(s), the proportion of the wax isomerized oil according to the present embodiment in such a mixed base oil is preferably 30% by mass or more, more preferably 50% by mass or more, further preferably 70% by mass or more.

Such other base oil for use in combination with the wax isomerized oil according to the present embodiment is not particularly limited, and examples of a mineral base oil include mineral oils classified to Group I to Group III in the API classification.

Examples of a synthetic base oil include poly α-olefins or hydrogenated products thereof, isobutene oligomers or hydrogenated products thereof, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate, and the like), polyol esters (trimethylolpropane caprylate, trimethylolpropane pelargonate, pentaerythritol 2-ethylhexanoate, pentaerythritol pelargonate, and the like), polyoxyalkylene glycols, dialkyl diphenyl ethers, and polyphenyl ethers, and among them, poly α-olefins are preferable. Examples of such poly α-olefins typically include oligomers or co-oligomers of α-olefins of 2 to 32, preferably 6 to 16 carbon atoms (1-octene oligomer, decene oligomer, ethylene-propylene co-oligomer, and the like) and hydrogenated products thereof.

The method for producing such poly α-olefins is not particularly limited, and examples thereof include a method involving polymerizing α-olefins in the presence of a polymerization catalyst such as a Friedel-Crafts catalyst including a complex of aluminum trichloride or boron trifluoride with water, any alcohol (ethanol, propanol, butanol, or the like), any carboxylic acid or any ester thereof.

It is possible to, if necessary, compound various additives to the wax isomerized oil according to the present embodiment or a mixed base oil of the wax isomerized oil with other base oil. Such an additive is not particularly limited, and it is possible to compound any additive conventionally used in the lubricating oil field. Specific examples of such an additive of a lubricating oil include an antioxidant, an ashless dispersant, a metallic cleaning agent, an extreme-pressure agent, an anti-wear agent, a viscosity index improver, a pour point depressant, a friction adjuster, an oiliness agent, a corrosion inhibitor, a rust inhibitor, a demulsifier, a metal deactivating agent, a seal swelling agent, a defoamer and a colorant. Such additives may be used singly or in combinations of two or more thereof.

EXAMPLES

Hereinafter, the present invention will be more specifically described based on Examples and Comparative Examples, but the present invention is not limited to the following Examples at all.

[Measurement of Number Average Molecular Weight (Mn) and Weight Average Molecular Weight (Mw)]

Two columns (product name: PL gel 10 μm MIXED-B LS manufactured by Polymer Laboratories Ltd.) were connected to a high-temperature GPC apparatus (product name: PL-20 manufactured by Polymer Laboratories Ltd.), thereby providing a differential refractive index detector. To 5 mg of a sample was added 5 ml of o-dichlorobenzene, and heated and stirred at 140° C. for about 1 hour. Such a sample thus dissolved was subjected to measurement by setting the flow rate to 1 ml/min and the temperature of a column oven to 140° C. Conversion of the molecular weight was performed based on the calibration curve created with standard polystyrene, and the molecular weight in terms of polystyrene was determined.

[Calculation of Catalyst Efficiency]

The catalyst efficiency was calculated by dividing the weight of the resulting oligomer by the number of moles of a catalyst loaded.

Example 1-1

An iron compound (50 mg) represented by formula (1a) and a ligand (19 mg) represented by formula (2a) were introduced into a 500-mL eggplant flask and dry toluene (200 mL) was added thereto, under a nitrogen stream. A solution of methylaluminoxane in hexane (3.64 M solution, 11 mL) was added to the toluene solution, thereby producing solution (A).

Dry toluene (8 L) and a solution of methylaluminoxane in hexane (3.64 M solution, 2.8 mL) were introduced under a nitrogen stream into a 20-L autoclave equipped with an electromagnetic induction stirrer sufficiently dried at 110° C. under reduced pressure in advance, and the temperature was adjusted to 30° C.

Solution (A) was introduced into the above-described autoclave, thereby producing an ethylene polymerization catalyst. The proportion of methylaluminoxane contained in the resulting ethylene polymerization catalyst was 500 equivalents relative to the number of moles of the iron compound.

Ethylene (at (30° C. and 1 MPa) was continuously introduced into the autoclave which solution (A) was introduced. After 9 hours, such introduction of ethylene was stopped, the unreacted ethylene was purged, and ethanol (100 mL) was added to deactivate the ethylene polymerization catalyst. The autoclave was opened, the content was transferred to a 20-L eggplant flask, and the solvent was distilled off under reduced pressure to thereby obtain semi-solid ethylene oligomer wax (WAX 1). The catalyst efficiency (C.E.) was 60824 kg Olig/Fe mol. The Mn, Mw and Mw/Mn of WAX 1 obtained were 490, 890 and 1.8, respectively. The results obtained by gas chromatographic analysis under the following conditions, with respect to the content of a linear hydrocarbon compound of WAX 1 obtained, and the results obtained by field desorption mass spectrometry under the following conditions, with respect to the content (content of an even number of carbon atoms) of a hydrocarbon compound having an even number of carbon atoms are shown in Table 1.

[Gas Chromatography Conditions]

Column: liquid phase non-polar column (length: 25 mm, inner diameter: 0.3 mmϕ, thickness of liquid phase: 0.1 μm)

Temperature rise condition: 50 to 400° C. (speed of temperature rise: 10° C./min)

Carrier gas: helium (linear speed: 40 cm/min)

Split ratio: 90/1

Injection volume of sample: 0.5 μL (injection volume of sample diluted with carbon disulfide 20-fold)

Detector: hydrogen flame ionization detector (FID)

[Field Desorption Mass Analysis Conditions]

The mass was analyzed by diluting each isomerized oil with toluene about 20-fold, coating an emitter therewith, and allowing current to flow for ionization.

(Analysis Conditions)

Apparatus: JEOL JMS-T300GC

Ionization method; FD (Field Desorption)

Ion source temperature: room temperature

Opposite electrode voltage: −10 kV

Emitter current: 6.4 mA/min

Spectrum recording interval: 0.4 sec

Measurement mass range: m/z 35 to 1600

WAX 1 obtained above was separated by distillation to thereby obtain a fraction whose boiling point range was 350 to 450° C. The resulting fraction was hydroisomerized with a zeolite-based hydroisomerization catalyst whose noble metal content was adjusted to 0.1 to 5% by mass, under conditions of a reaction temperature of 330° C., a hydrogen partial pressure of 5 MPa and a liquid hourly space velocity of 1.0 $hr^{-1}$, to thereby obtain a wax isomerized oil. Subsequently, the resulting wax isomerized oil was distilled under reduced pressure to thereby obtain a wax isomerized oil corresponding to 70Pale. Characteristics of the resulting wax isomerized oil are shown in Table 2. In Table 2, "Carbon number distribution", "Average number of carbon atoms" and "Content of even number of carbon atoms" are each measured and calculated by performing field desorption mass analysis with respect to the resulting wax isomerized oil, and "Traction coefficient" is a value measured by using a steel ball and a steel disc as test pieces under conditions of a load of 20 N, a test oil temperature of 25° C., a circumferential velocity of 0.52 m/s and a slip ratio of 3% (the same applies hereinafter). A chromatogram obtained by performing electrolysis desorption mass spectrometry with respect to the resulting wax isomerized oil is illustrated in FIG. 1.

Example 1-2

Figure 2:
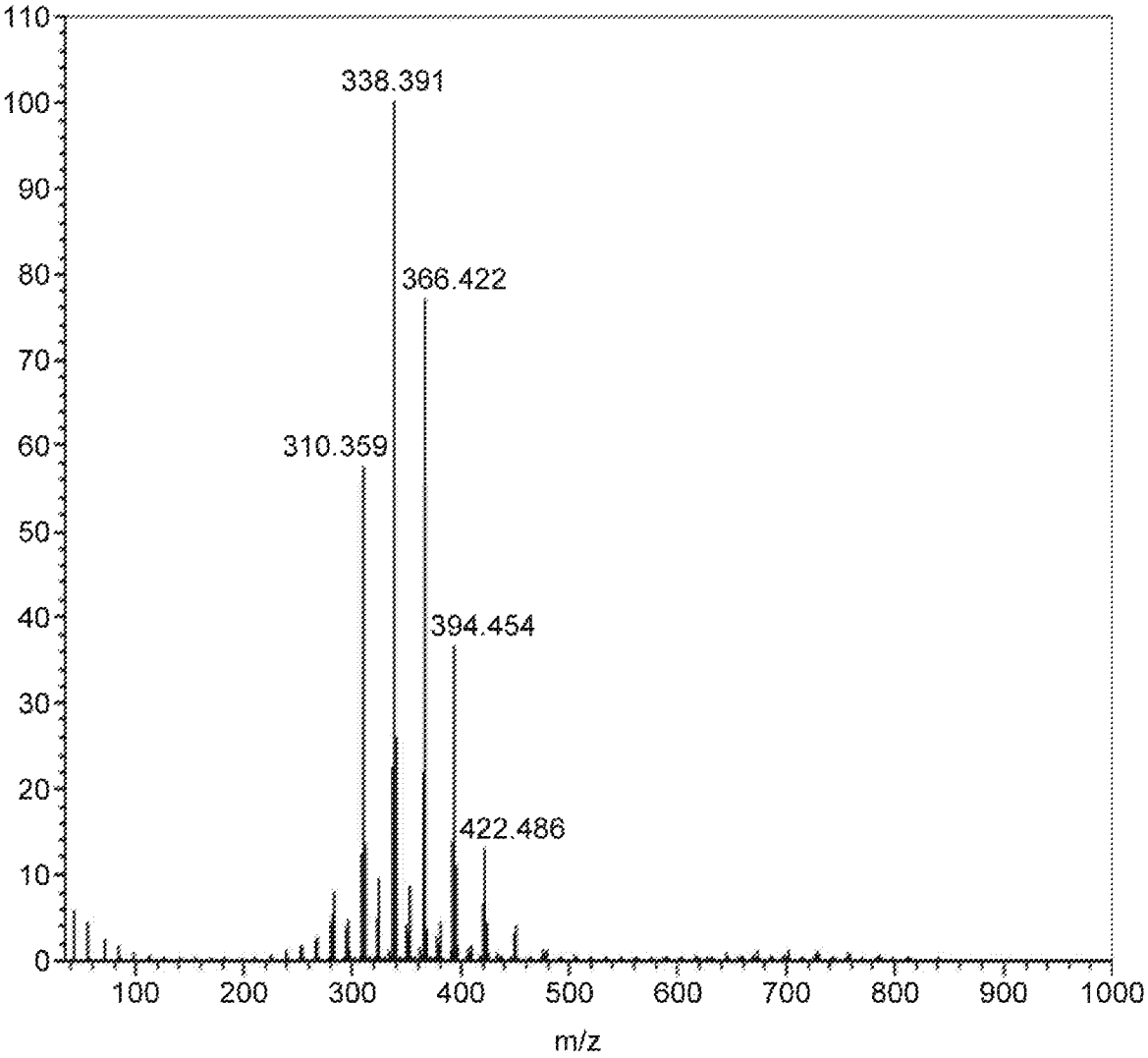
FIG. 2 A chromatogram obtained by performing Field Desorption-Mass Spectroscopy with respect to a wax isomerized oil obtained in Example 1-2.

A wax isomerized oil was obtained according to the same method as in Example 1-1 except that the reaction temperature in hydroisomerization was changed to 340° C. Characteristics of the resulting wax isomerized oil are shown in Table 2. A chromatogram obtained by performing electrolysis desorption mass spectrometry with respect to the resulting wax isomerized oil is illustrated in FIG. 2.

Example 1-3

Figure 3:
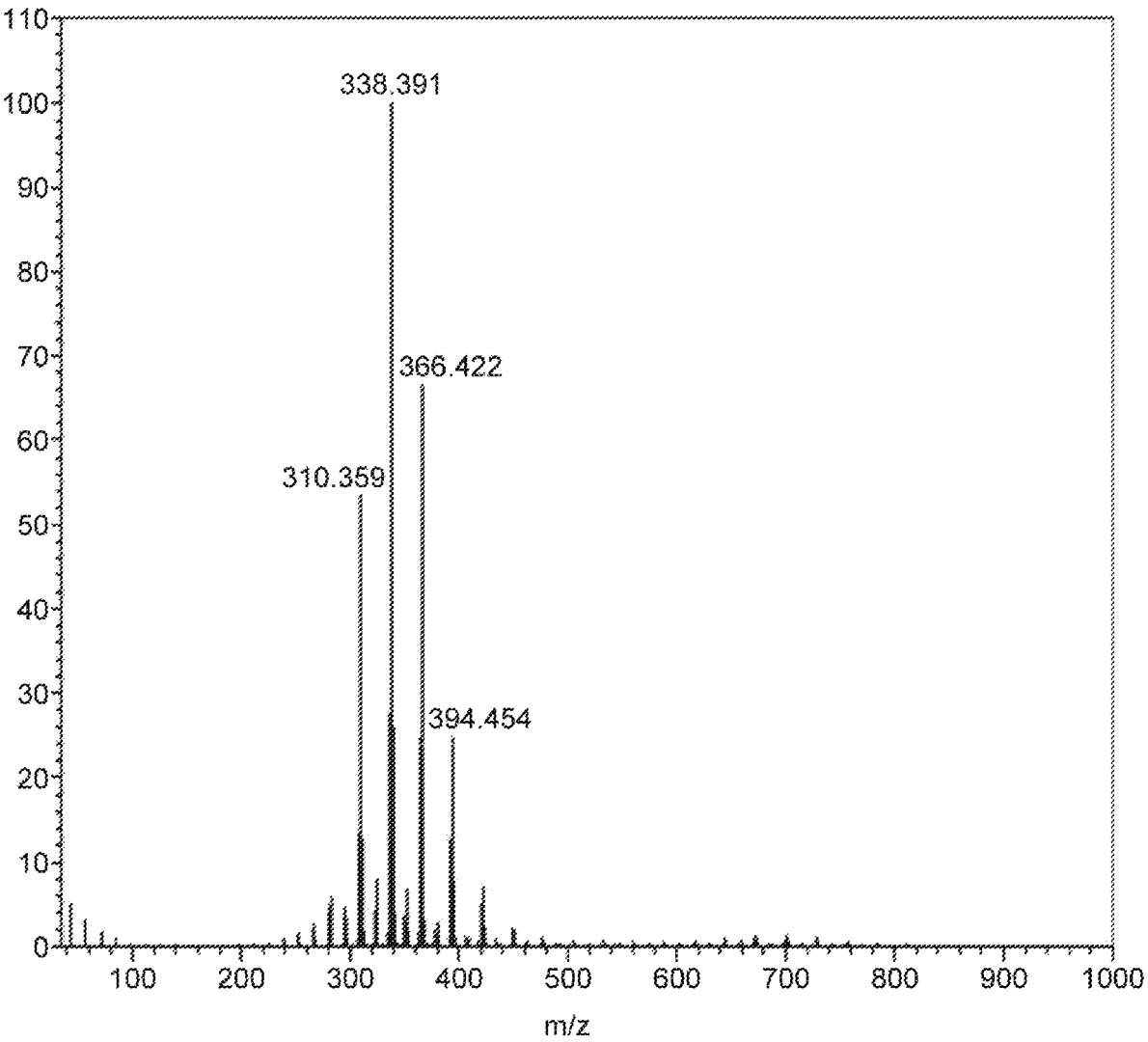
FIG. 3 A chromatogram obtained by performing Field Desorption-Mass Spectroscopy with respect to a wax isomerized oil obtained in Example 1-3.

A wax isomerized oil was obtained according to the same method as in Example 1-1 except that the reaction temperature in hydroisomerization was changed to 320° C. Characteristics of the resulting wax isomerized oil were favorable as in the wax isomerized oils obtained in Example 1-1 and Example 1-2. A chromatogram obtained by performing electrolysis desorption mass spectrometry with respect to the resulting wax isomerized oil is illustrated in FIG. 3.

Comparative Example 1-1

FT wax (WAX 2) whose content of paraffin was 93% by mass and which had a carbon number distribution of 18 to 60 was used as a raw material wax. The content of normal paraffin in WAX 2, as a result obtained by gas chromatographic analysis, and the content (content of an even number of carbon atoms) of the hydrocarbon compound having an even number of carbon atoms, as a result obtained by performing electrolysis desorption mass spectrometry, are shown in Table 1.

Figure 4:
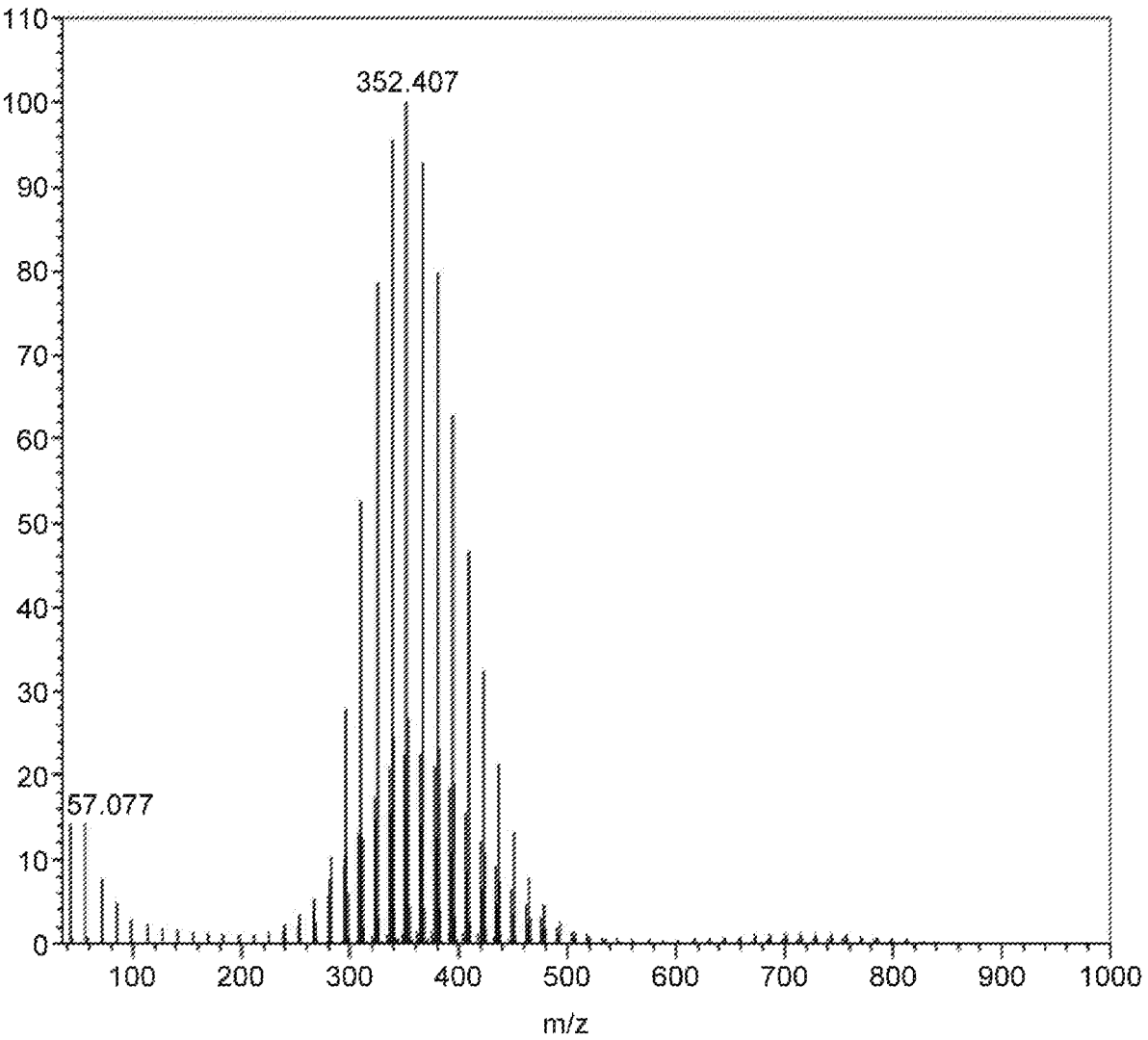
FIG. 4 A chromatogram obtained by performing Field Desorption-Mass Spectroscopy with respect to a wax isomerized oil obtained in Comparative Example 1-1.

A wax isomerized oil was obtained by using the above-described WAX 2 according to the same method as in Example 1-1. Characteristics of the resulting wax isomerized oil are shown in Table 2. A chromatogram obtained by performing electrolysis desorption mass spectrometry with respect to the resulting wax isomerized oil is illustrated in FIG. 4.

Comparative Example 1-2

Figure 5:
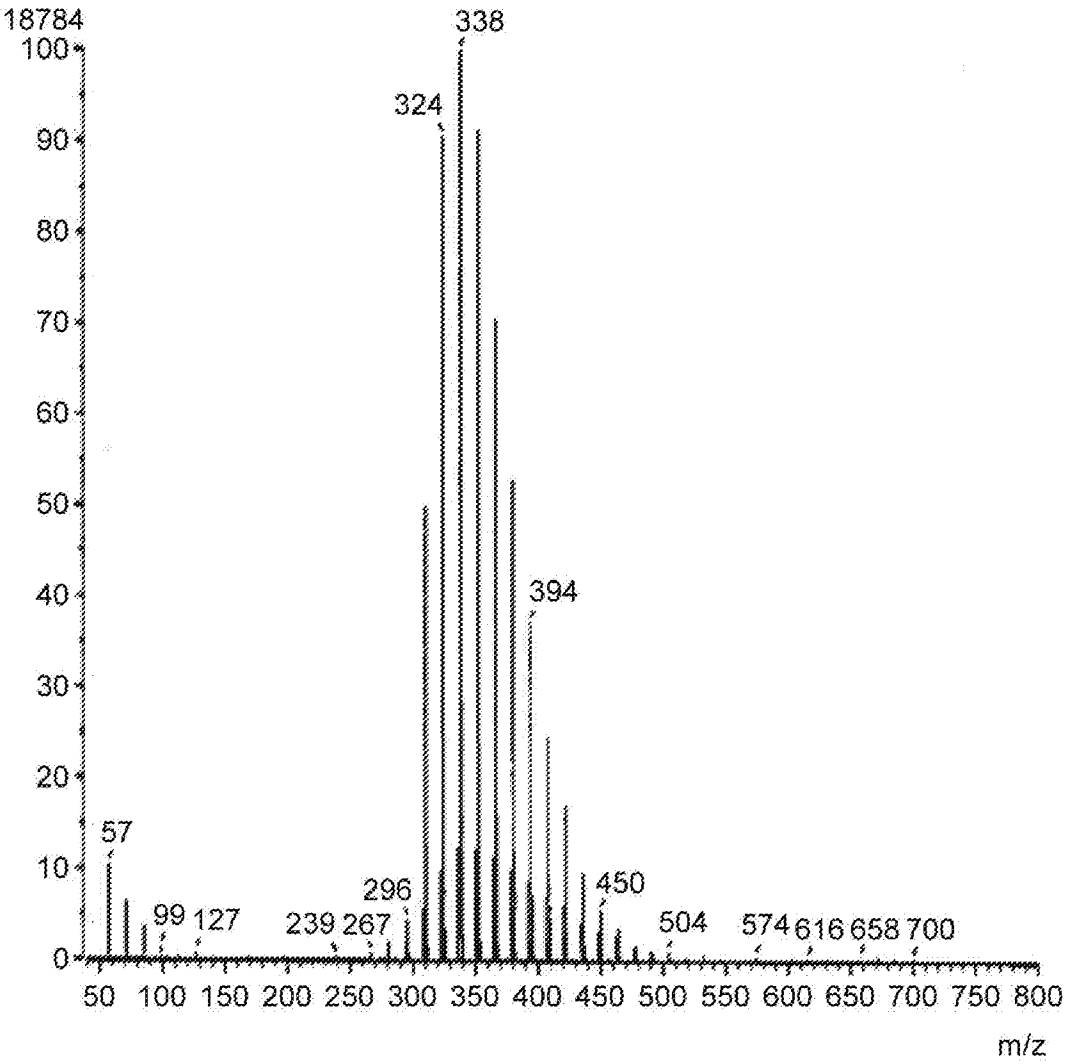
FIG. 5 A chromatogram obtained by performing Field Desorption-Mass Spectroscopy with respect to a wax isomerized oil obtained in Comparative Example 1-2.

A wax isomerized oil was obtained according to the same method as in Comparative Example 1-1 except that the reaction temperature in hydroisomerization was changed to 340° C. Characteristics of the resulting wax isomerized oil are shown in Table 2. A chromatogram obtained by performing electrolysis desorption mass spectrometry with respect to the resulting wax isomerized oil is illustrated in FIG. 5.

Comparative Example 1-3

Production of a wax isomerized oil was tried according to the same method as in Comparative Example 1-1 except that the reaction temperature in hydroisomerization was changed to 320° C., but it was confirmed that a product was clouded. It clearly indicated that no isomerization reaction normally progressed and that no wax isomerized oil was obtained.

Example 1-4

WAX 1 was separated by distillation to thereby obtain a fraction whose boiling point range was 350 to 450° C. Hydrocracking of the resulting fraction was performed in the presence of a hydrocracking catalyst under conditions of a reaction temperature of 350° C., a hydrogen partial pressure of 5 MPa and a liquid hourly space velocity of 1.0 $hr^{-1}$, thereby obtaining a cracked product. As the hydrocracking catalyst, a catalyst where 3% by mass of nickel and 15% by mass of molybdenum were supported on an amorphous silica-alumina carrier (silica:alumina=20:80 (mass ratio)) was used in the state of being sulfurized. Subsequently, the resulting cracked product was hydroisomerized by using a zeolite-based hydroisomerization catalyst whose noble metal content was adjusted to 0.1 to 5% by mass, under conditions of a reaction temperature of 330° C., a hydrogen partial pressure of 5 MPa and a liquid hourly space velocity of 1.0 $hr^{-1}$, thereby obtaining a wax isomerized oil. Subsequently, the resulting wax isomerized oil was distilled under reduced pressure, thereby obtaining a wax isomerized oil corresponding to 70Pale. Characteristics of the resulting wax isomerized oil are shown in Table 2.

Comparative Example 1-4

A wax isomerized oil was obtained by using WAX 2 according to the same method as in Example 1-4. Characteristics of the resulting wax isomerized oil are shown in Table 2.

TABLE 1

| Name of raw material wax | WAX 1 | WAX 2 |
|---|---|---|
| GC analysis | | |
| Content of normal paraffin (% by mass) | 71* | 93 |
| FD-MS analysis | | |
| Content of even number of carbon atoms (% by mass) | 100 | 50 |

*also includes a linear olefin having the same number of carbon atoms whose retention time matches that of normal paraffin as a standard substance

TABLE 2

| | Example 1-1 | Example 1-2 | Comparative Example 1-1 | Comparative Example 1-2 | Example 1-4 | Comparative Example 1-4 |
|---|---|---|---|---|---|---|
| Raw material oil | WAX 1 | WAX 1 | WAX 2 | WAX 2 | WAX 1 | WAX 2 |
| Hydroisomerization reaction temperature, ° C. | 330 | 340 | 330 | 340 | 330 | 330 |
| Fractional distillation of raw material, ° C. | 350-450 | 350-450 | 350-450 | 350-450 | 350-450 | 350-450 |
| Viscosity grade | 70 pale | 70 pale | 70 pale | 70 pale | 70 pale | 70 pale |
| Density (15° C.), g/cm$^3$ | 0.81 | 0.81 | 0.81 | 0.81 | 0.81 | 0.81 |
| Kinetic viscosity (100° C.), mm$^2$/s | 2.66 | 2.61 | 2.63 | 2.61 | 2.66 | 2.60 |
| Viscosity index | 142 | 135 | 130 | 128 | 132 | 127 |
| Pour point, ° C. | −25 | −32.5 | −25 | −30 | −22.5 | −20 |
| Carbon number distribution | 16-35 | 16-35 | 16-39 | 16-34 | 16-35 | 16-36 |
| Average number of carbon atoms | 24.6 | 24.9 | 25.9 | 25.5 | 24.8 | 25.8 |
| Even number of carbon atoms, % by mass | 88 | 87 | 50 | 50 | 70 | 50 |
| Traction coefficient | 0.0021 | 0.0022 | 0.0026 | 0.0026 | 0.0023 | 0.0025 |

Example 2-1

Figure 6:
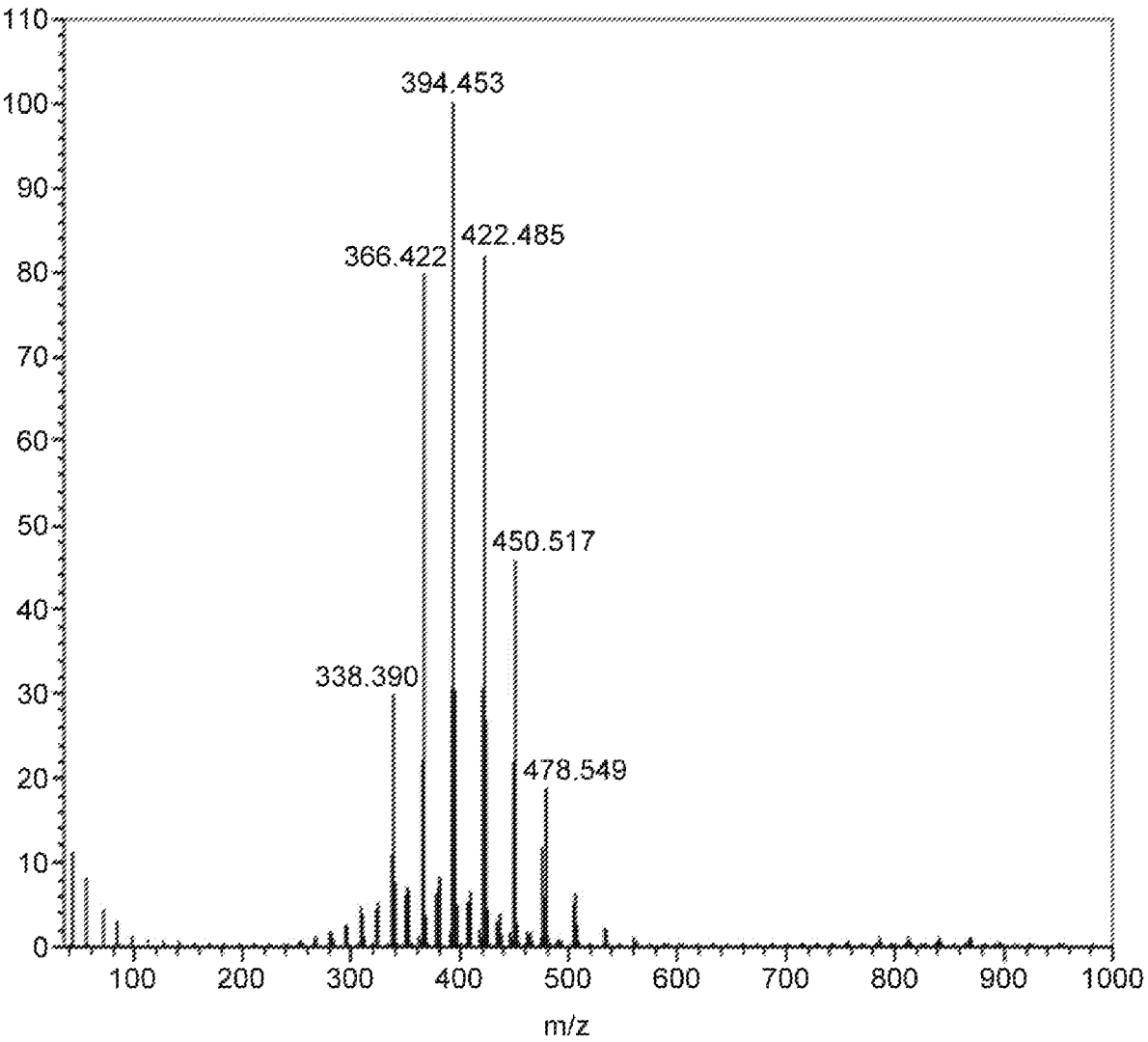
FIG. 6 A chromatogram obtained by performing Field Desorption-Mass Spectroscopy with respect to a wax isomerized oil obtained in Example 2-1.

A wax isomerized oil was obtained according to the same method as in Example 1-1 except that, in Example 2-1, WAX 1 was separated by distillation, a fraction whose boiling point range was 420 to 500° C. was used, and a wax isomerized oil corresponding to SAE-10 was obtained in distillation under reduced pressure of the resulting wax isomerized oil. Characteristics of the wax isomerized oil obtained in Example 2-1 are shown in Table 3. A chromatogram obtained by performing electrolysis desorption mass spectrometry with respect to the resulting wax isomerized oil is illustrated in FIG. 6.

Example 2-2

Figure 7:
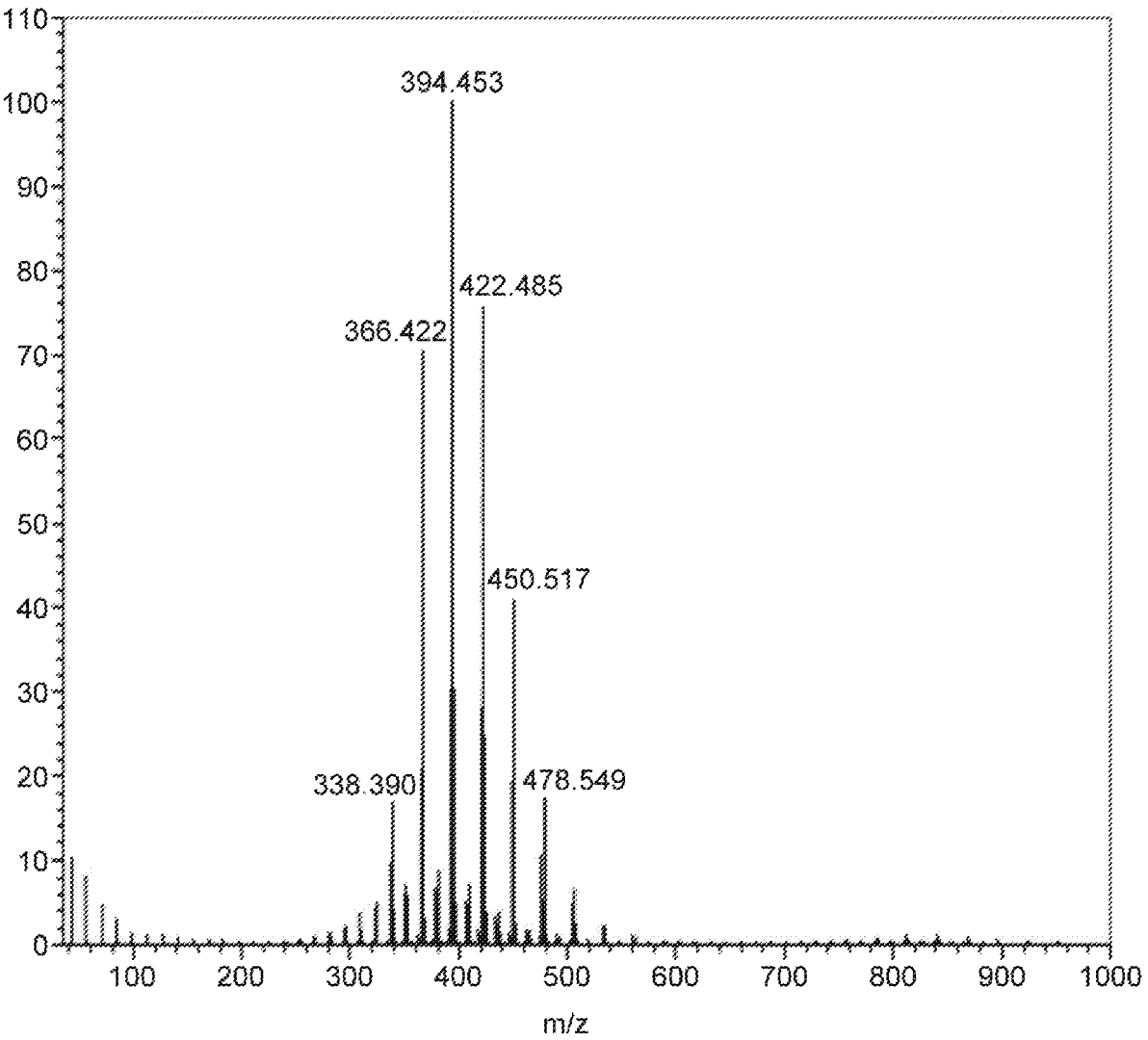
FIG. 7 A chromatogram obtained by performing Field Desorption-Mass Spectroscopy with respect to a wax isomerized oil obtained in Example 2-2.

A wax isomerized oil was obtained according to the same method as in Example 2-1 except that the reaction temperature in hydroisomerization was changed to 340° C. Characteristics of the resulting wax isomerized oil are shown in Table 3. A chromatogram obtained by performing electrolysis desorption mass spectrometry with respect to the resulting wax isomerized oil is illustrated in FIG. 7.

Example 2-3

Figure 8:
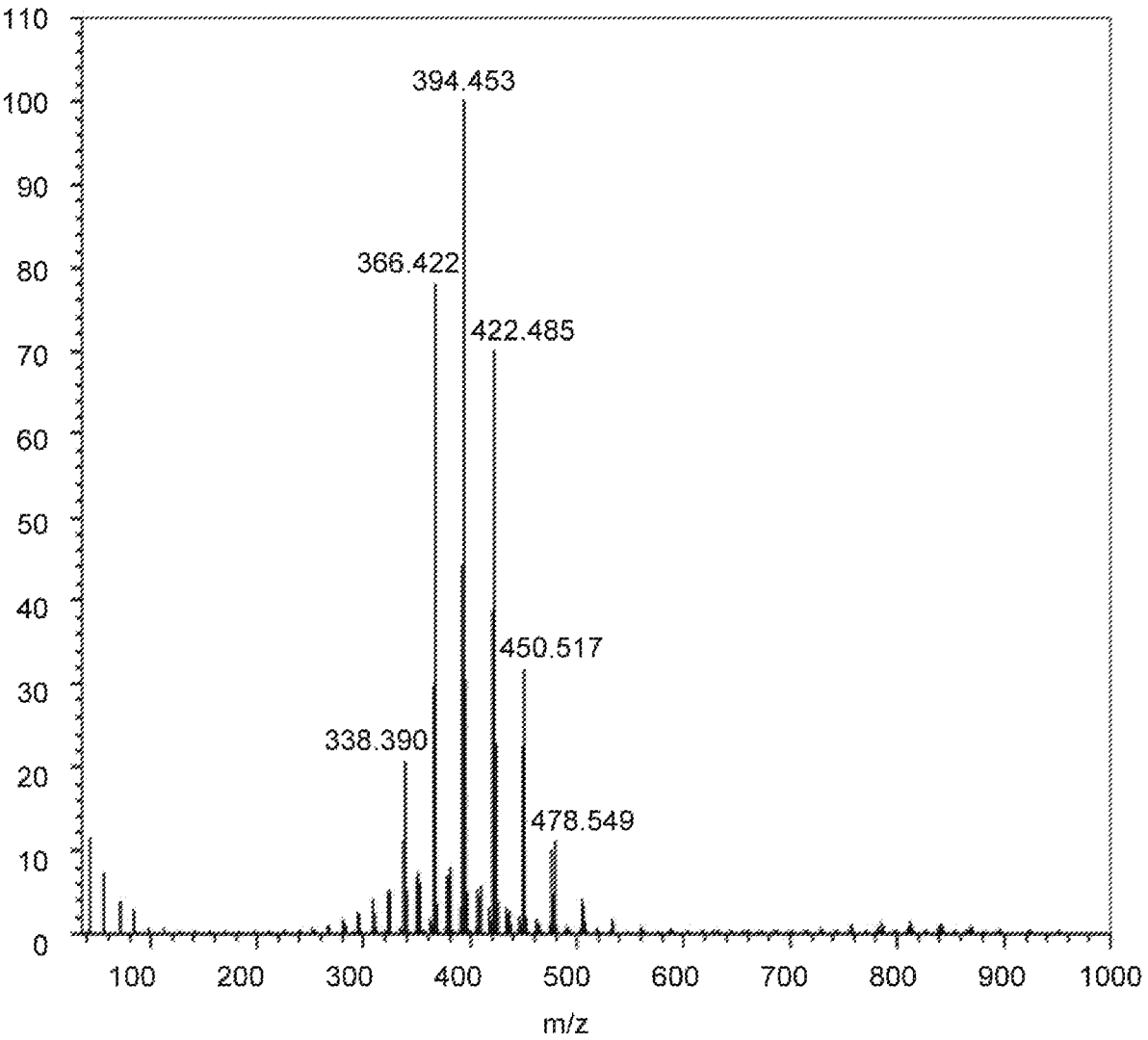
FIG. 8 A chromatogram obtained by performing Field Desorption-Mass Spectroscopy with respect to a wax isomerized oil obtained in Example 2-3.

A wax isomerized oil was obtained according to the same method as in Example 2-1 except that the reaction temperature in hydroisomerization was changed to 320° C. Characteristics of the resulting wax isomerized oil were favorable as in the wax isomerized oils obtained in Example 2-1 and Example 2-2. A chromatogram obtained by performing electrolysis desorption mass spectrometry with respect to the resulting wax isomerized oil is illustrated in FIG. 8.

Comparative Example 2-1

Figure 9:
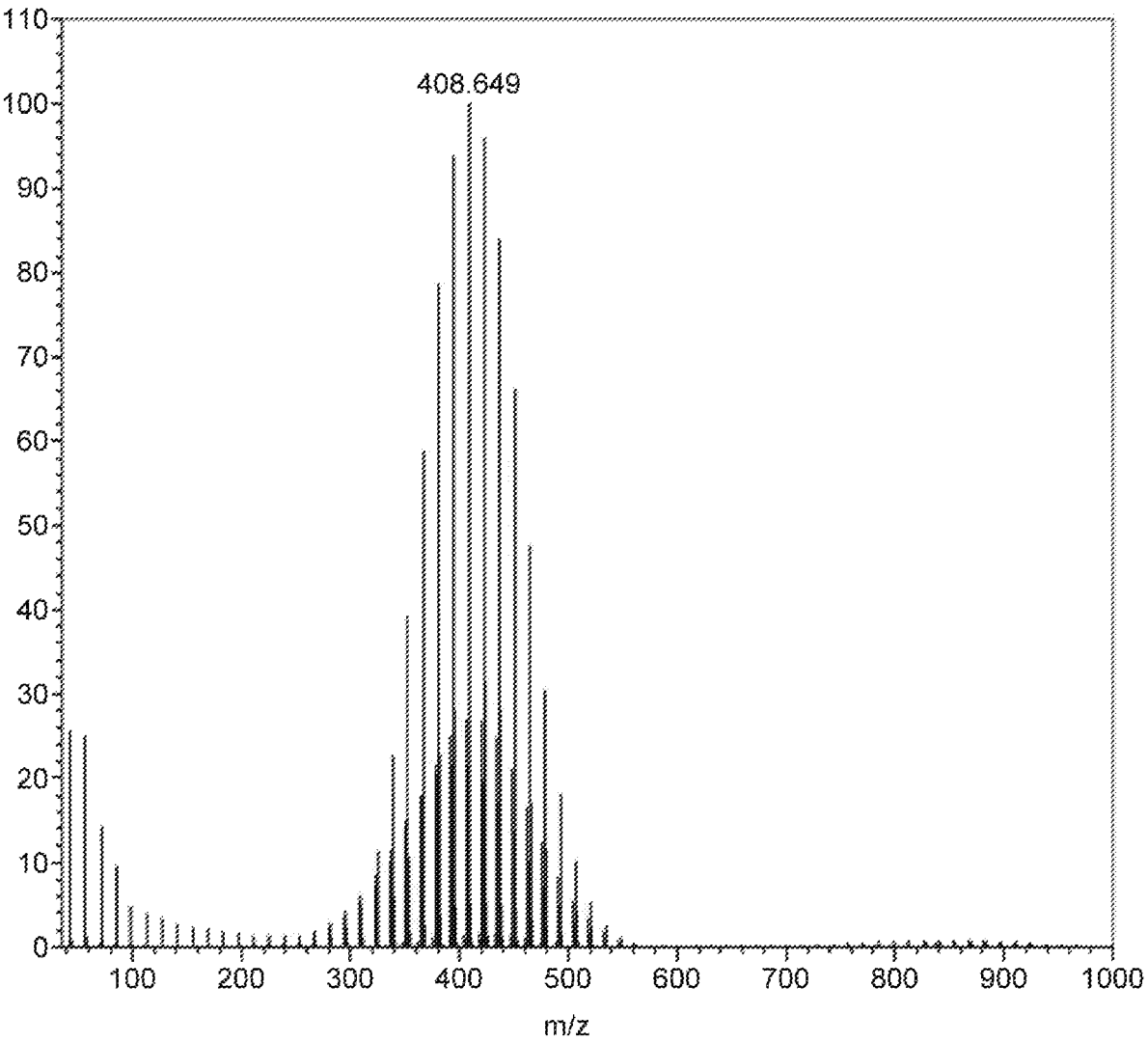
FIG. 9 A chromatogram obtained by performing Field Desorption-Mass Spectroscopy with respect to a wax isomerized oil obtained in Comparative Example 2-1.

A wax isomerized oil was obtained according to the same method as in Example 2-1 except that WAX 2 was used in Comparative Example 2-1. Characteristics of the wax isomerized oil obtained in Comparative Example 2-1 are shown in Table 3. A chromatogram obtained by performing electrolysis desorption mass spectrometry with respect to the resulting wax isomerized oil is illustrated in FIG. 9.

Comparative Example 2-2

Figure 10:
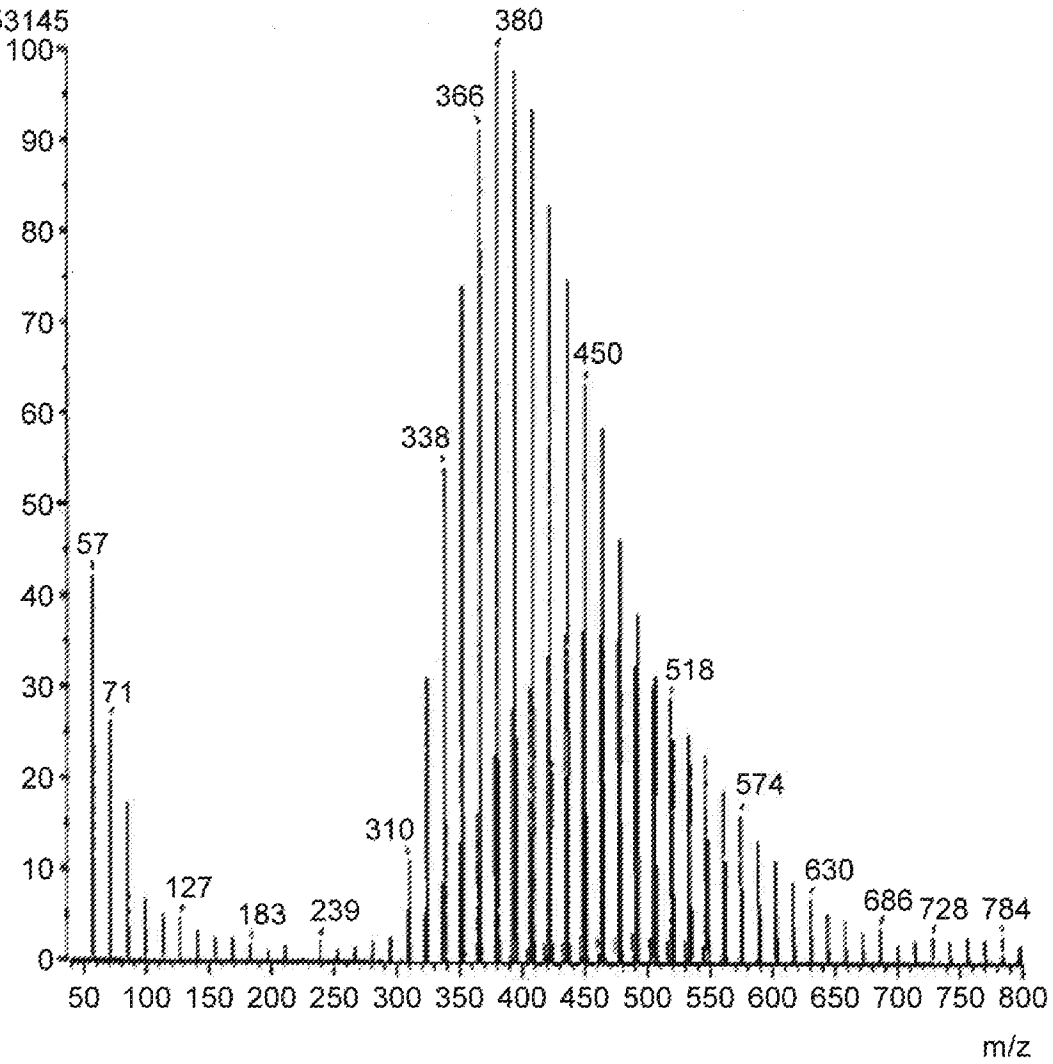
FIG. 10 A chromatogram obtained by performing Field Desorption-Mass Spectroscopy with respect to a wax isomerized oil obtained in Comparative Example 2-2.

A wax isomerized oil was obtained according to the same method as in Comparative Example 2-1 except that the reaction temperature in hydroisomerization was changed to 340° C. Characteristics of the wax isomerized oil obtained in Comparative Example 2-2 are shown in Table 3. A chromatogram obtained by performing electrolysis desorption mass spectrometry with respect to the resulting wax isomerized oil is illustrated in FIG. 10.

Comparative Example 2-3

Production of a wax isomerized oil was tried according to the same method as in Comparative Example 2-1 except that the reaction temperature in hydroisomerization was changed to 320° C., but it was confirmed that a product was clouded. It clearly indicated that no isomerization reaction normally progressed and that no wax isomerized oil was obtained.

Example 2-4

A wax isomerized oil was obtained according to the same method as in Example 1-4 except that a fraction corresponding to SAE-10 was obtained in distillation under reduced pressure of the wax isomerized oil in Example 2-4. Characteristics of the wax isomerized oil obtained in Example 2-4 are shown in Table 3.

Comparative Example 2-4

A wax isomerized oil was obtained by using WAX 2 according to the same method as in Example 2-4. Characteristics of the resulting wax isomerized oil are shown in Table 3.

TABLE 3

| | Example 2-1 | Example 2-2 | Comparative Example 2-1 | Comparative Example 2-2 | Example 2-4 | Comparative Example 2-4 |
|---|---|---|---|---|---|---|
| Raw material oil | WAX 1 | WAX 1 | WAX 2 | WAX 2 | WAX 1 | WAX 2 |
| Hydroisomerization reaction temperature, ° C. | 330 | 340 | 330 | 340 | 330 | 330 |
| Fractional distillation of raw material, ° C. | 420-500 | 420-500 | 420-500 | 420-500 | 420-500 | 420-500 |
| Viscosity grade | SAE-10 | SAE-10 | SAE-10 | SAE-10 | SAE-10 | SAE-10 |
| Density (15° C.), g/cm$^3$ | 0.81 | 0.81 | 0.81 | 0.81 | 0.81 | 0.81 |
| Kinetic viscosity (100° C.), mm$^2$/s | 3.86 | 3.86 | 3.87 | 3.86 | 3.91 | 3.91 |
| Viscosity index | 151 | 148 | 143 | 141 | 145 | 142 |
| Pour point, ° C. | −17.5 | −20 | −17.5 | −20 | −20 | −20 |
| Carbon number distribution | 18-42 | 18-42 | 18-39 | 22-50 | 18-42 | 18-40 |
| Average number of carbon atoms | 28.6 | 28.8 | 29.2 | 31.3 | 28.5 | 29.4 |
| Even number of carbon atoms, % by mass | 87 | 87 | 50 | 50 | 70 | 50 |
| Traction coefficient | 0.0023 | 0.0025 | 0.0028 | 0.0029 | 0.0025 | 0.0030 |

Example 3-1

A wax isomerized oil was obtained according to the same method as in Example 1-1 except that, in Example 3-1, WAX 1 was separated by distillation, a fraction whose boiling point range was 300 to 440° C. was used, and the resulting wax isomerized oil was distilled under reduced pressure to thereby obtain a wax isomerized oil corresponding to VG6. Characteristics of the wax isomerized oil obtained in Example 3-1 are shown in Table 4.

Comparative Example 3-1

A wax isomerized oil was obtained according to the same method as in Example 3-1 except that WAX 2 was used in Comparative Example 3-1. Characteristics of the wax isomerized oil obtained in Comparative Example 3-1 are shown in Table 4.

Example 3-2

A wax isomerized oil was obtained according to the same method as in Example 1-4 except that a fraction whose boiling point range was 300 to 440° C., of WAX 1, was used as a raw material in Example 3-2. Characteristics of the wax isomerized oil obtained in Example 3-2 are shown in Table 4.

Comparative Example 3-2

A wax isomerized oil was obtained by using the above-described WAX 2 according to the same method as in Example 3-2. Characteristics of the resulting wax isomerized oil are shown in Table 4.

TABLE 4

| | Example 3-1 | Comparative Example 3-2 | Example 3-2 | Comparative Example 3-2 |
|---|---|---|---|---|
| Raw material oil | WAX 1 | WAX 2 | WAX 1 | WAX 2 |
| Fractional distillation of raw material, ° C. | 300-440 | 300-440 | 300-440 | 300-440 |
| Viscosity grade | VG6 | VG6 | VG6 | VG6 |
| Density (15° C.), g/cm$^3$ | 0.78 | 0.78 | 0.79 | 0.79 |
| Kinetic viscosity (100° C.), mm$^2$/s | 2.02 | 2.01 | 2.03 | 2.01 |
| Viscosity index | 133 | 125 | 130 | 120 |
| Pour point, ° C. | −35 | −35 | −32.5 | −32.5 |
| Carbon number distribution | 14-30 | 14-31 | 15-30 | 15-30 |
| Average number of carbon atoms | 21.4 | 21.5 | 21.7 | 21.9 |
| Even number of carbon atoms, % by mass | 88 | 50 | 70 | 50 |
| Traction coefficient | 0.0019 | 0.0027 | 0.0023 | 0.0026 |

Each wax isomerized oil according to the present invention was excellent in viscosity-temperature characteristics and exhibited a low traction coefficient.

On the other hand, Comparative Examples where FT wax was used as a raw material instead of the ethylene polymer wax caused the results where viscosity-temperature characteristics were inferior and the traction coefficient was high as compared with the wax isomerized oil according to the present invention which was equivalent in viscosity grade.

The invention claimed is:

1. A wax isomerized oil, wherein a content of a hydrocarbon compound having an even number of carbon atoms, as determined from a chromatogram obtained by mass spectrometry, is more than 80% by mass based on a total amount of the wax isomerized oil;

wherein the wax isomerized oil is an isomerized oil of an ethylene polymer wax not subjected to any hydrocracking treatment.

2. The wax isomerized oil according to claim 1, wherein the wax isomerized oil is an isomerized oil obtained by hydroisomerizing an ethylene polymer wax at a temperature of 315° C. or more and 350° C. or less.

3. The wax isomerized oil according to claim 1, wherein the wax isomerized oil is an isomerized oil obtained by hydroisomerizing an ethylene polymer wax at a temperature of 325° C. or more and 335° C. or less.

* * * * *